US010132164B2

(12) United States Patent
Dumont et al.

(10) Patent No.: US 10,132,164 B2
(45) Date of Patent: Nov. 20, 2018

(54) SYSTEMS AND METHODS FOR IN-SITU MEASUREMENTS OF MIXED FORMATION FLUIDS

(71) Applicant: Schlumberger Technology Corporation, Sugar Land, TX (US)

(72) Inventors: Hadrien Dumont, Houston, TX (US); Christopher Harrison, Auburndale, MA (US); Youxiang Zuo, Burnaby (CA); Christopher Albert Babin, Waveland, MS (US); Abhishek Agarwal, Sugar Land, TX (US); Adriaan Gisolf, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 352 days.

(21) Appl. No.: 14/975,698

(22) Filed: Dec. 18, 2015

(65) Prior Publication Data

US 2017/0175524 A1 Jun. 22, 2017

(51) Int. Cl.
*E21B 49/08* (2006.01)
*E21B 49/10* (2006.01)

(52) U.S. Cl.
CPC ..... *E21B 49/10* (2013.01); *E21B 49/081* (2013.01)

(58) Field of Classification Search
CPC .... E21B 2049/085; E21B 33/12; E21B 47/06; E21B 47/065; E21B 49/082; E21B 49/10
See application file for complete search history.

(56) References Cited

U.S. PATENT DOCUMENTS 4,690,216 A * 9/1987 Pritchard, Jr. ..... E21B 43/116 166/165
5,691,809 A 11/1997 Tackett et al.
6,755,079 B1 * 6/2004 Proett ..... E21B 47/00 73/152.18
8,335,650 B2 12/2012 Hsu et al.
8,564,768 B2 10/2013 Schroeder et al.
8,910,514 B2 12/2014 Sullivan et al.
(Continued)

FOREIGN PATENT DOCUMENTS

WO WO2014158376 A1 10/2014

OTHER PUBLICATIONS

Office Action issued in the related U.S. Appl. No. 15/087,770, dated May 11, 2018 (27 pages).

*Primary Examiner* — James G Sayre
(74) *Attorney, Agent, or Firm* — Michael Dae

(57) ABSTRACT

Systems and methods for obtaining in-situ measurements of mixed formation fluids are provided. A downhole acquisition tool may move to a first station in a wellbore in a geological formation to collect a sample of first formation fluid from the first station. The downhole acquisition tool may move to a second station in the wellbore and a sample of second formation fluid may be collected. A proportion of the first formation fluid and the second formation fluid may be mixed within the downhole acquisition tool in-situ while the downhole acquisition tool is within the wellbore to obtain a formation fluid mixture. The formation fluid mixture may be passed into a fluid testing component of the downhole acquisition tool while the downhole acquisition tool is in the wellbore to measure fluid properties of the formation fluid mixture in-situ.

20 Claims, 25 Drawing Sheets

(56) References Cited

U.S. PATENT DOCUMENTS

| | | | | |
|---|---|---|---|---|
| 9,303,510 | B2 | 4/2016 | Dumont et al. | |
| 2012/0024050 | A1* | 2/2012 | Godager | E21B 41/0085 73/152.05 |
| 2012/0145400 | A1* | 6/2012 | Harrison | B01F 11/0082 166/305.1 |
| 2013/0111985 | A1* | 5/2013 | Veeningen | E21B 47/06 73/152.51 |
| 2013/0219997 | A1 | 8/2013 | Sullivan et al. | |
| 2013/0243028 | A1 | 9/2013 | Singh et al. | |
| 2016/0362977 | A1* | 12/2016 | Feng | E21B 49/10 |
| 2017/0284197 | A1 | 10/2017 | Dumont et al. | |

* cited by examiner

SYSTEMS AND METHODS FOR IN-SITU MEASUREMENTS OF MIXED FORMATION FLUIDS

BACKGROUND

This disclosure relates to measuring in-situ properties of a mixture of formation fluids from different depths to identify properties relating to the compatibility of the formation fluids.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of any kind.

Reservoir fluid analysis may be used in a wellbore in a geological formation to locate hydrocarbon-producing regions in the geological formation, as well as to manage production of the hydrocarbons in these regions. A downhole acquisition tool may carry out reservoir fluid analysis by drawing in formation fluid and testing the formation fluid downhole or collecting a sample of the formation fluid to bring to the surface. For example, the downhole acquisition tool may use a probe and/or packers to isolate a desired region of the wellbore (e.g., at a desired depth) and establish fluid communication with the subterranean formation surrounding the wellbore. The probe may draw the formation fluid into the downhole acquisition tool. Once inside the downhole acquisition tool, the formation fluid may be directed to a fluid analysis component containing sensors that can measure fluid properties of the formation fluid. The hydrocarbon-producing regions in the geological formation may be located based on the measured fluid properties of the formation fluid.

Many reservoirs may have more than one hydrocarbon-producing region. The different formation fluids from each region may have their own particular fluid properties. When formation fluids from different regions mix, however, the mixture may have distinct properties from that of either of the original formation fluids. Depending on the properties of the mixture, the formation fluids from different regions may or may not be compatible with one another. In many cases, the properties of a mixture of formation fluids from different regions may be estimated based on the individually measured properties of the different formation fluids. In other cases, samples of each of the formation fluids from the different regions may be obtained individually and brought to the surface for analysis in a laboratory. Still, it may be difficult to estimate the behavior of a mixture of the different formation fluids from the different regions based on the properties of each formation fluid individually. Moreover, mixing the formation fluids in a laboratory at the surface may not fully reveal the manner in which the same mixture might behave in the downhole environment. Since the behavior of the mixture of the different formation fluids from the different hydrocarbon zones of the wellbore may impact the decisions for managing the well to produce these hydrocarbons, it is highly valuable to identify whether the formation fluid from the different hydrocarbon zones are compatible.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

Systems and methods for obtaining in-situ measurements of mixed formation fluids are provided. For example, a method may include moving a downhole acquisition tool to a first station in a wellbore in a geological formation and collecting a sample of first formation fluid from the first station using the downhole acquisition tool. The downhole acquisition tool may be moved to a second station in the wellbore and a sample of second formation fluid may be obtained from the second station. A proportion of the first formation fluid and the second formation fluid may be mixed within the downhole acquisition tool in-situ while the downhole acquisition tool is within the wellbore to obtain a formation fluid mixture and the formation fluid mixture may be passed into a fluid testing component of the downhole acquisition tool while the downhole acquisition tool is in the wellbore to measure fluid properties of the formation fluid mixture in-situ.

In another example, a downhole acquisition tool that may be placed in a wellbore in a geological formation to perform in-situ fluid testing of a formation fluid mixture may include a first flowline, a second flowline, a comingle valve that selectively permits or denies fluid communication between the first flowline and the second flowline, a probe that draws formation fluid in from outside the downhole acquisition tool onto the first flowline via an interval valve disposed between the first flowline and the probe, first and second sample chambers attached to the first and second flowlines at first and second respective locations, a first pump attached to the first flowline at a third location, and a pressure-volume-temperature tester disposed along the first flowline. When the downhole acquisition tool is at a first station, the first pump may pump first formation fluid from the first station into the first sample chamber. When the downhole acquisition tool is at a second station, the first pump may pump second formation fluid from the second station into the second sample chamber. The first and second sample chambers may be simultaneously pressed with force fluid to cause the simultaneous release of the first formation fluid and the second formation fluid onto the first flowline and into the pressure-volume-temperature tester as the formation fluid mixture.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

Figure 1:
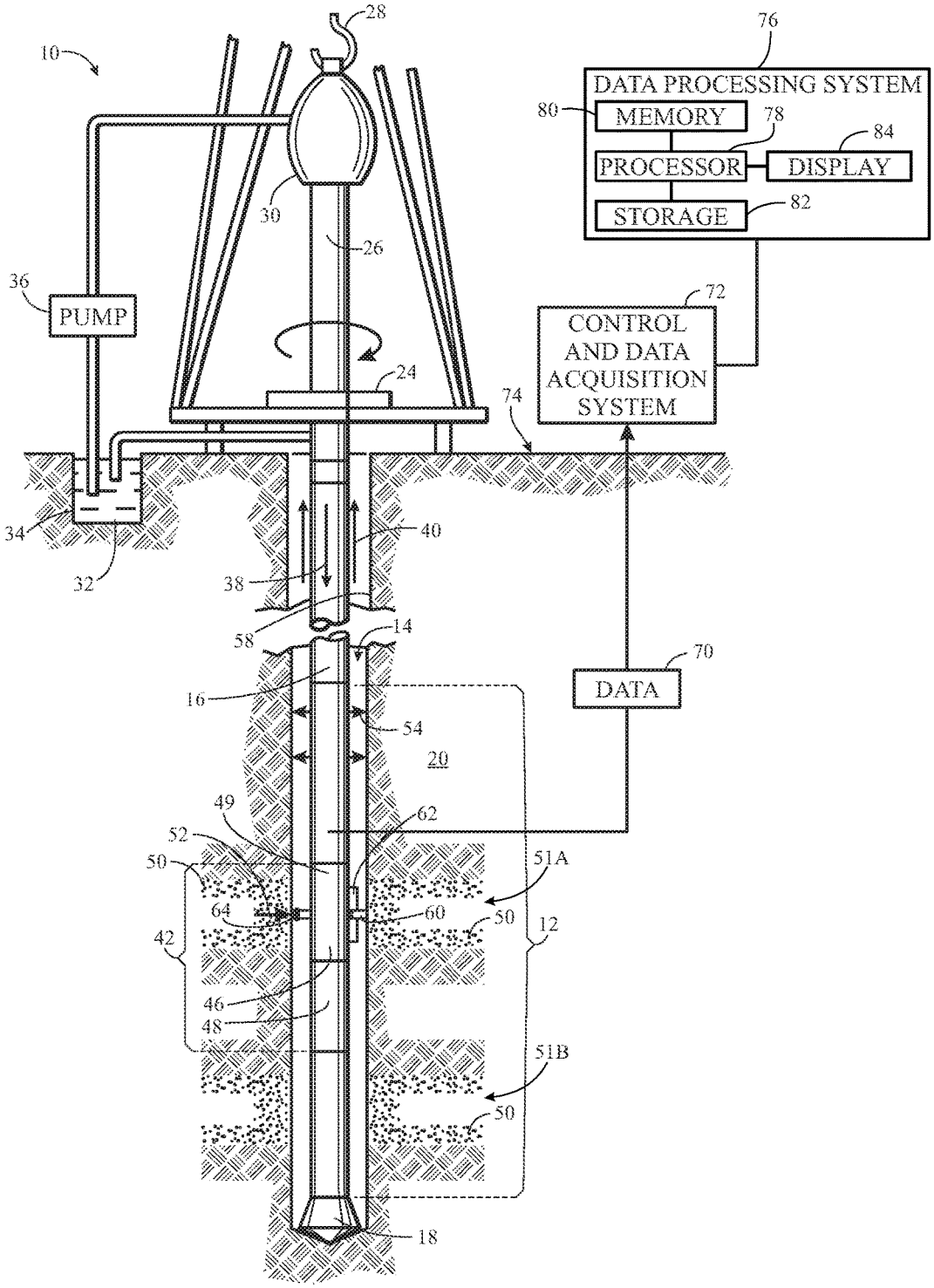
FIG. 1 is a schematic diagram of a logging-while-drilling wellsite system that may be used to identify the compatibility of formation fluids from two different stations in the wellbore, in accordance with an embodiment.

One or more specific embodiments of the present disclosure will be described below. These described embodiments are examples of the presently disclosed techniques. Additionally, in an effort to provide a concise description of these embodiments, features of an actual implementation may not be described in the specification. It should be appreciated that in the development of any such actual implementation, as in any engineering or design project, numerous implementation-specific decisions may be made to achieve the developers' specific goals, such as compliance with system-related and business-related constraints, which may vary from one implementation to another. Moreover, it should be appreciated that such a development effort might be complex and time consuming, but would still be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

A wellbore drilled into a geological formation may pass through more than one fluid zone containing formation fluid. Each formation fluid from each zone may have a particular set of properties that describe its behavior. A downhole acquisition tool may measure some of these properties, which may include fluid viscosity, density, composition, gas-to-oil ratio (GOR), differential vaporization, asphaltene onset pressure (AOP), saturation pressure (PSAT), or wax appearance temperature (WAT), to name a few. When multiple fluid zones are produced, however, the formation fluids may mix to produce a mixed formation fluid that has new properties. The new properties of the mixed formation fluid may be difficult to predict based on measurements of the original formation fluids individually. It may be highly valuable to ascertain the properties of the mixed formation fluid, however, to identify whether formation fluids from the different fluid zones are compatible, and thus may be produced together from the same well, or whether the formation fluids from the different zones are not compatible, and thus may more properly be kept separate during production (e.g., via different wells).

One way in which a mixture of formation fluids from different fluid zones may vary from their individual formation fluid components may be the phase envelopes that describe the behavior of the mixed fluid. Phase envelopes may be diagrammatically represented as curves relating pressure and temperature. On different sides of the curve, the formation fluid may have different phase behavior. For example, a saturation pressure (PSAT) phase envelope describes the temperature and pressures delineating liquid vs. gas behavior. When the formation fluid is at a temperature and pressure above the PSAT phase envelope, the formation fluid may be substantially gas-free, but when the formation fluid is at a temperature and pressure on the other side of the PSAT phase envelope, gas bubbles may begin to form in the formation fluid. In another example, an asphaltene onset pressure (AOP) phase envelope describes the temperature and pressures delineating the appearance of asphaltene components in the formation fluid. When the formation fluid is at a temperature and pressure above the AOP phase envelope, the formation fluid may be substantially free of asphaltenes, but when the formation fluid is at a temperature and pressure on the other side of the AOP phase envelope, asphaltene components may begin to fall out of solution in the formation fluid.

Accurately modeling the phase envelopes of the formation fluids may be tremendously valuable for hydrocarbon exploration and production. Indeed, as formation fluids are produced, the formation fluids may experience a range of temperatures and pressures. As a formation fluid is produced, the temperatures and pressures of the well may gradually decrease. At some point, the temperatures and pressures may reach a "bubble point" when the fluid breaks phase at the saturation pressure (PSAT), producing gaseous and liquid phases. In addition, the formation fluid may break phase in the formation itself during production. For example, one zone of the formation may contain oil with dissolved gas. During production, the formation pressure may drop to the extent that the bubble point pressure is reached, allowing gas to emerge from the oil, causing production concerns. At times, too, the formation fluid may experience changes in pressure and temperature that cause asphaltenes to begin to appear, which could result in production-choking "tar mats." Thus, accurate modeling of the phase envelopes may be very helpful when designing production strategies.

Moreover, other fluid properties may also change with temperature and pressure. As noted above, the temperature tends to decrease as the fluid is transiting from the wellbore bottom to the surface. This tends to increase the fluid viscosity as the formation fluid is being extracted. To accurately calculate the flow rate during production, an accurate estimate of the viscosity may be useful.

Rather than, or in addition to, measuring the properties of individual formation fluids from different fluid zones and estimating the properties of the mixture from the individual measurements, the systems and methods of this disclosure may mix and measure the formation fluids downhole in-situ. In one example, formation fluids may be sampled at different stations and stored in first and second sample chambers. Part of the formation fluid samples from each of the stations may be moved from the separate sample chambers where they were collected into a third sample chamber located on the other side of a pump on a flowline connecting the sample chambers. For example, the third sample chamber may be half-filled with the each of the formation fluids, to produce a half/half mixture of the formation fluids from the two stations. This mixture may be analyzed in a fluid analysis component or a pressure-volume-temperature (PVT) tester that may be used to identify a saturation pressure and/or an asphaltene onset pressure (AOP) of the mixture. Additionally or alternatively, the mixture from the third sample chamber may be pushed into a fourth sample chamber (and/or back into the third sample chamber) to further mix the fluids before the mixture is tested.

Fewer sample chambers may also be used. For instance, formation fluids from different stations may be pumped into different respective sample chambers. Thereafter, the formation fluids may be pushed out of the sample chambers at the same time. This may cause the formation fluids to mix in the flowline on the way to a fluid-testing component such as the PVT tester. By applying variable pressures to the sample chambers (e.g., by using a different pump to force fluid out of each sample chamber), different proportions of formation fluid mixtures may be tested.

Figure 2:
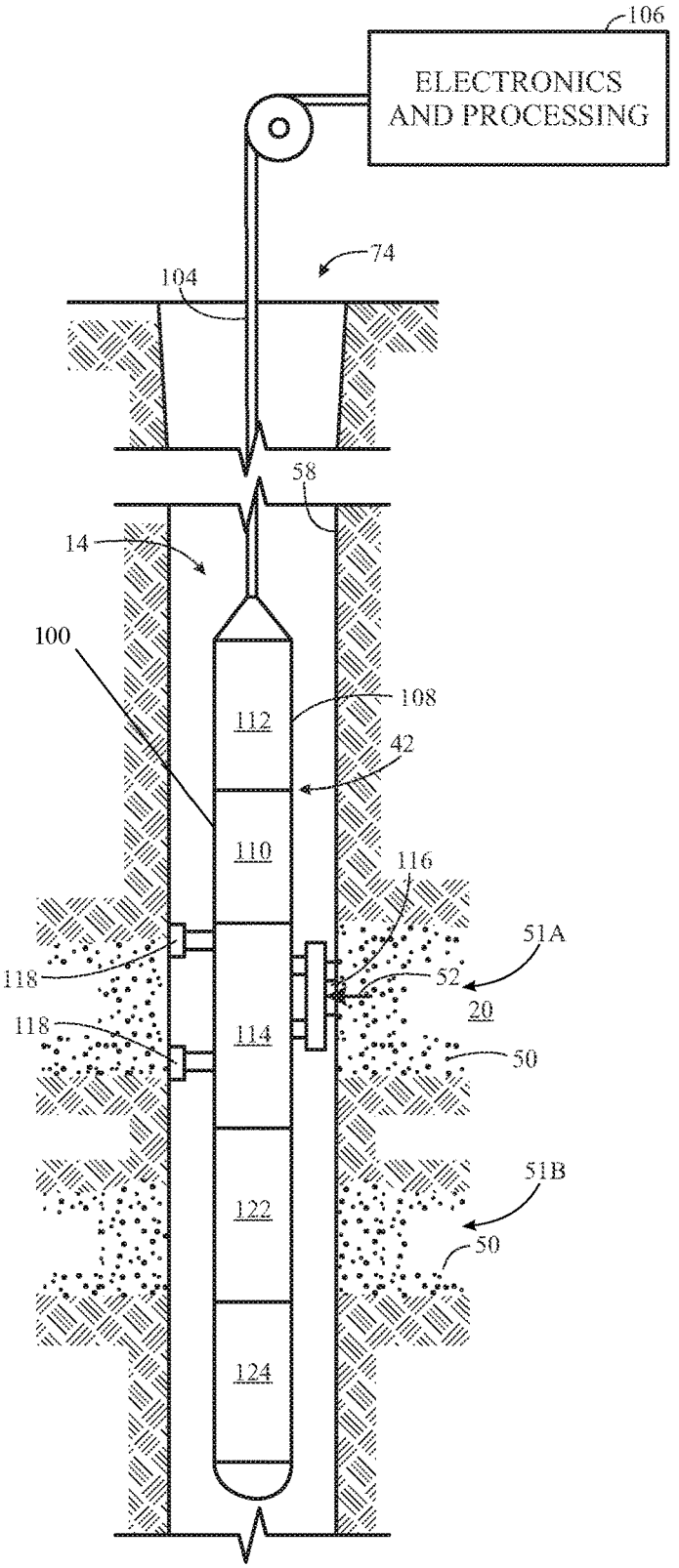
FIG. 2 is a schematic diagram of another example of a wireline wellsite system that may be used to identify the compatibility of the formation fluids from two different stations in the wellbore, in accordance with an embodiment.

FIGS. 1 and 2 depict examples of wellsite systems that may employ such fluid analysis systems and methods. In FIG. 1, a rig 10 suspends a downhole acquisition tool 12 into a wellbore 14 via a drill string 16. A drill bit 18 drills into a geological formation 20 to form the wellbore 14. The drill string 16 is rotated by a rotary table 24, which engages a kelly 26 at the upper end of the drill string 16. The drill string 16 is suspended from a hook 28, attached to a traveling block, through the kelly 26 and a rotary swivel 30 that permits rotation of the drill string 16 relative to the hook 28. The rig 10 is depicted as a land-based platform and derrick assembly used to form the wellbore 14 by rotary drilling. However, in other embodiments, the rig 10 may be an offshore platform.

Drilling fluid referred to as drilling mud 32, is stored in a pit 34 formed at the wellsite. A pump 36 delivers the drilling mud 32 to the interior of the drill string 16 via a port in the swivel 30, inducing the drilling mud 32 to flow downwardly through the drill string 16 as indicated by a directional arrow 38. The drilling mud 32 exits the drill string 16 via ports in the drill bit 18, and then circulates upwardly through the region between the outside of the drill string 16 and the wall of the wellbore 14, called the annulus, as indicated by directional arrows 40. The drilling mud 32 lubricates the drill bit 18 and carries formation cuttings up to the surface as it is returned to the pit 34 for recirculation.

The downhole acquisition tool 12, sometimes referred to as a component of a bottom hole assembly ("BHA"), may be positioned near the drill bit 18 and may include various components with capabilities such as measuring, processing, and storing information, as well as communicating with the surface. Additionally or alternatively, the downhole acquisition tool 12 may be conveyed on wired drill pipe, a combination of wired drill pipe and wireline, or other suitable types of conveyance.

The downhole acquisition tool 12 may further include a sampling system 42, which may include a fluid communication module 46, a sampling module 48, and a sample bottle module 49. In a logging-while-drilling (LWD) configuration, the modules may be housed in a drill collar for performing various formation evaluation functions, such as pressure testing and fluid sampling, among others, and collecting representative samples of native formation fluid 50. The example of FIG. 1 includes two fluid zones 51A and 51B where the native formation fluid 50 may enter the wellbore 14. The native formation fluid 50 from the fluid zones 51A and 51B may have different properties, particularly if the fluid zones 51A and 51B are hydraulically isolated from one another. As shown in FIG. 1, the fluid communication module 46 is positioned adjacent the sampling module 48; however the position of the fluid communication module 46, as well as other modules, may vary in other embodiments. Additional devices, such as pumps, gauges, sensors, monitors or other devices usable in downhole sampling and/or testing also may be provided. The additional devices may be incorporated into modules 46 or 48 or disposed within separate modules included within the sampling system 42.

The downhole acquisition tool 12 may evaluate fluid properties of an obtained fluid 52. Generally, when the obtained fluid 52 is initially taken in by the downhole acquisition tool 12, the obtained fluid 52 may include some drilling mud 32, some mud filtrate 54 on a wall 58 of the wellbore 14, and the native formation fluid 50. To isolate the native formation fluid 50, the downhole acquisition tool 12 may identify an amount of contamination that is likely present in the obtained fluid 52. When the contamination level is sufficiently low, the obtained fluid 52 may substantially represent uncontaminated native formation fluid 50. In this way, the downhole acquisition tool 12 may store a sample of the native formation fluid 50 or perform a variety of in-situ testing to identify properties of the native formation fluid 50. Accordingly, the sampling system 42 may include sensors that may measure fluid properties such as gas-to-oil ratio (GOR); mass density; optical density (OD); composition of carbon dioxide ($CO_2$), $C_1$, $C_2$, $C_3$, $C_4$, $C_5$, and/or $C_{6+}$; formation volume factor; viscosity; resistivity; conductivity, fluorescence; compressibility, and/or combinations of these properties of the obtained fluid 52. In on example, the sampling system 42 may include a pressure-volume-temperature (PVT) tester component that includes a volume that can change pressures using a piston or micro-piston. The PVT tester component may be used to identify a pressure where the fluid held in its volume crosses a phase envelope. The PVT tester component may operate as described by Application No. PCT/US2014/015467, which is incorporated by reference herein in its entirety for all purposes. In addition, the sampling system 42 may be used to monitor mud filtrate contamination to determine an amount of the drilling mud filtrate 54 in the obtained fluid 52. When the amount of drilling mud filtrate 54 in the obtained fluid 52 falls beneath a desired threshold, the remaining native formation fluid 50 may be stored as a sample and/or tested.

The fluid communication module 46 includes a probe 60, which may be positioned in a stabilizer blade or rib 62. The probe 60 includes one or more inlets for receiving the obtained fluid 52 and one or more flowlines (not shown) extending into the downhole tool 12 for passing fluids (e.g., the obtained fluid 52) through the tool. In certain embodiments, the probe 60 may include a single inlet designed to direct the obtained fluid 52 into a flowline within the downhole acquisition tool 12. Further, in other embodiments, the probe 60 may include multiple inlets (e.g., a sampling probe and a guard probe) that may, for example, be used for focused sampling. In these embodiments, the probe 60 may be connected to a sampling flowline, as well as to guard flowlines. The probe 60 may be movable between extended and retracted positions for selectively engaging the wellbore wall 58 of the wellbore 14 and acquiring fluid samples from the geological formation 20. One or more setting pistons 64 may be provided to assist in positioning the fluid communication device against the wellbore wall 58.

The sensors within the sampling system 42 may collect and transmit data 70 from the measurement of the fluid properties and the composition of the obtained fluid 52 to a control and data acquisition system 72 at surface 74, where the data 70 may be stored and processed in a data processing system 76 of the control and data acquisition system 72. The data processing system 76 may include a processor 78, memory 80, storage 82, and/or display 84. The memory 80 may include one or more tangible, non-transitory, machine readable media collectively storing one or more sets of instructions for operating the downhole acquisition tool 12 and estimating an amount of mud filtrate 54 in the obtained fluid 52. The memory 80 may store mixing rules and algorithms associated with the native formation fluid 50 (e.g., uncontaminated formation fluid), the drilling mud 32, and combinations thereof to facilitate estimating an amount of the drilling mud 32 in the obtained fluid 52. The data processing system 76 may use the fluid property and composition information of the data 70 to estimate an amount of the mud filtrate in the obtained fluid 52 and/or model phase envelopes or other properties of the obtained fluid 52. These may be used in one or more equations of state (EOS) models describing the obtained fluid 52 (e.g., the native formation fluid 50) or, more generally, a reservoir in the geological formation 20. Accordingly, more accurate estimates of the phase envelopes of the obtained fluid 52 may likely result in more accurate EOS models.

To process the data 70, the processor 78 may execute instructions stored in the memory 80 and/or storage 82. For example, the instructions may cause the processor 78 to estimate fluid and compositional parameters of the native formation fluid 50 of the obtained fluid 52, and control flow rates of the sample and guard probes, and so forth. As such, the memory 80 and/or storage 82 of the data processing system 76 may be any suitable article of manufacture that can store the instructions. By way of example, the memory 80 and/or the storage 82 may be ROM memory, random-access memory (RAM), flash memory, an optical storage medium, or a hard disk drive. The display 84 may be any suitable electronic display that can display information (e.g., logs, tables, cross-plots, etc.) relating to properties of the well as measured by the downhole acquisition tool 12. It should be appreciated that, although the data processing system 76 is shown by way of example as being located at the surface 74, the data processing system 76 may be located in the downhole acquisition tool 12. In such embodiments, some of the data 70 may be processed and stored downhole (e.g., within the wellbore 14), while some of the data 70 may be sent to the surface 74 (e.g., in real time or near real time).

FIG. 2 depicts an example of a wireline downhole tool 100 that may employ the systems and methods of this disclosure. The downhole tool 100 is suspended in the wellbore 14 from the lower end of a multi-conductor cable 104 that is spooled on a winch at the surface 74. Like the downhole acquisition tool 12, the wireline downhole tool 100 may be conveyed on wired drill pipe, a combination of wired drill pipe and wireline, or any other suitable conveyance. The cable 104 is communicatively coupled to an electronics and processing system 106. The downhole tool 100 includes an elongated body 108 that houses modules 110, 112, 114, 122, and 124, that provide various functionalities including fluid sampling, sample bottle filling, fluid testing, operational control, and communication, among others. For example, the modules 110 and 112 may provide additional functionality such as fluid analysis, resistivity measurements, operational control, communications, coring, and/or imaging, among others.

As shown in FIG. 2, the module 114 is a fluid communication module 114 that has a selectively extendable probe 116 and backup pistons 118 that are arranged on opposite sides of the elongated body 108. The extendable probe 116 selectively seals off or isolates selected portions of the wall 58 of the wellbore 14 to fluidly couple to the adjacent geological formation 20 and/or to draw fluid samples from the geological formation 20. For example, the probe 116 may obtain and store some native formation fluid 50 from the first fluid zone 51A and obtain and store some native formation fluid 50 from the second fluid zone 51B. The probe 116 may include a single inlet or multiple inlets designed for guarded or focused sampling. The native formation fluid 50 may be expelled to the wellbore 14 through a port in the body 108 or the obtained fluid 52, including the native formation fluid 50, may be sent to one or more fluid sampling modules 122 and 124. The fluid sampling modules 122 and 124 may include sample chambers that store the obtained fluid 52. In the illustrated example, the electronics and processing system 106 and/or a downhole control system are configured to control the extendable probe assembly 116 and/or the drawing of a fluid sample from the geological formation 20 to enable analysis of the obtained fluid 52.

Figure 3:
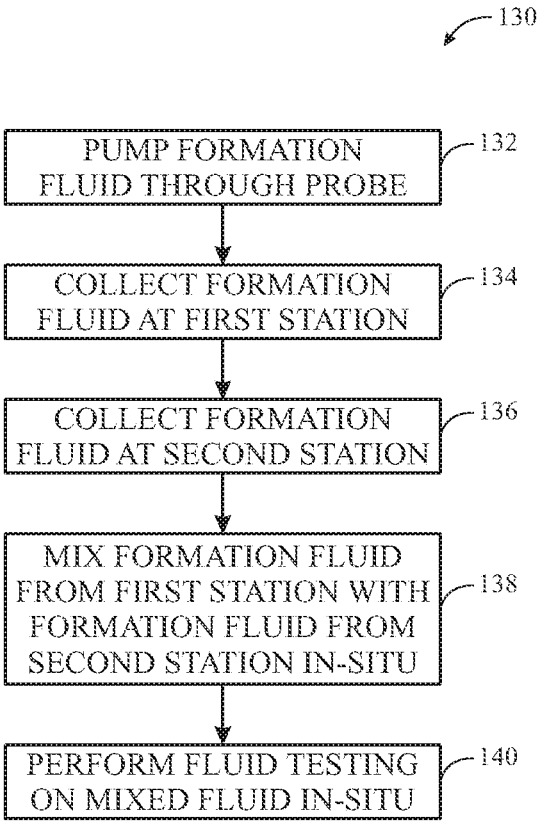
FIG. 3 is a flowchart of a method for identifying the compatibility of formation fluids from two different stations in a well, in accordance with an embodiment.

Using these or any other suitable downhole acquisition tools, samples of formation fluids 50 may be obtained at two different stations—that is, two different depths—and the formation fluids 50 from the two different stations may be mixed in-situ. For example, as shown by a flowchart 130 of FIG. 3, a downhole acquisition tool 12 containing a sampling system 42 may be placed into the wellbore 14 and fluid pumped through the probe (block 132). In particular, at a first station—for example, a depth within the first fluid zone 51A—obtained fluid 52 may be pumped through the probe until it contains a threshold amount of native formation fluid 50. A sample of the formation fluid 50 at the first station may be collected and stored in a sample chamber of the sampling system 42 (block 134). Thereafter, the downhole acquisition tool 12 may move to a second station where formation fluid 50 may also be collected and stored in a sample chamber of the sampling system 42 (block 136). For instance, the formation fluid 50 from the second fluid zone 51B may be collected at block 136.

As mentioned above, it is possible that the formation fluids 50 from the first fluid zone 51A and second fluid zone 51B may not be compatible. Indeed, the properties of a mixture of the formation fluids 50 from these two zones could behave unexpectedly in comparison to the individual properties of each fluid. As such, the formation fluids 50 from the first station and second station may be mixed in-situ (block 138) and fluid testing may be performed on the mixed fluid in-situ (block 140). For instance, a PVT tester component of the sampling system 42 may identify measurements of saturation pressure (PSAT), wax appearance temperature (WAT), or asphaltene onset pressure (AOP) of the fluid mixture. Other fluid properties of the mixed fluid may also be obtained in-situ, including fluid viscosity, density, composition, gas-to-oil ratio (GOR), differential vaporization, and so forth. By obtaining the properties of the formation fluids 50 from different stations in-situ, properties of the mixed fluid as the fluids actually behave in the downhole environment may be determined. The in-situ measurements of the mixture of the formation fluids 50 may be used as an alternative or in addition to estimates of mixed-fluid properties based on individual measurements or measurements made in a laboratory by mixing the formation fluids 50 at the surface.

Figure 4:
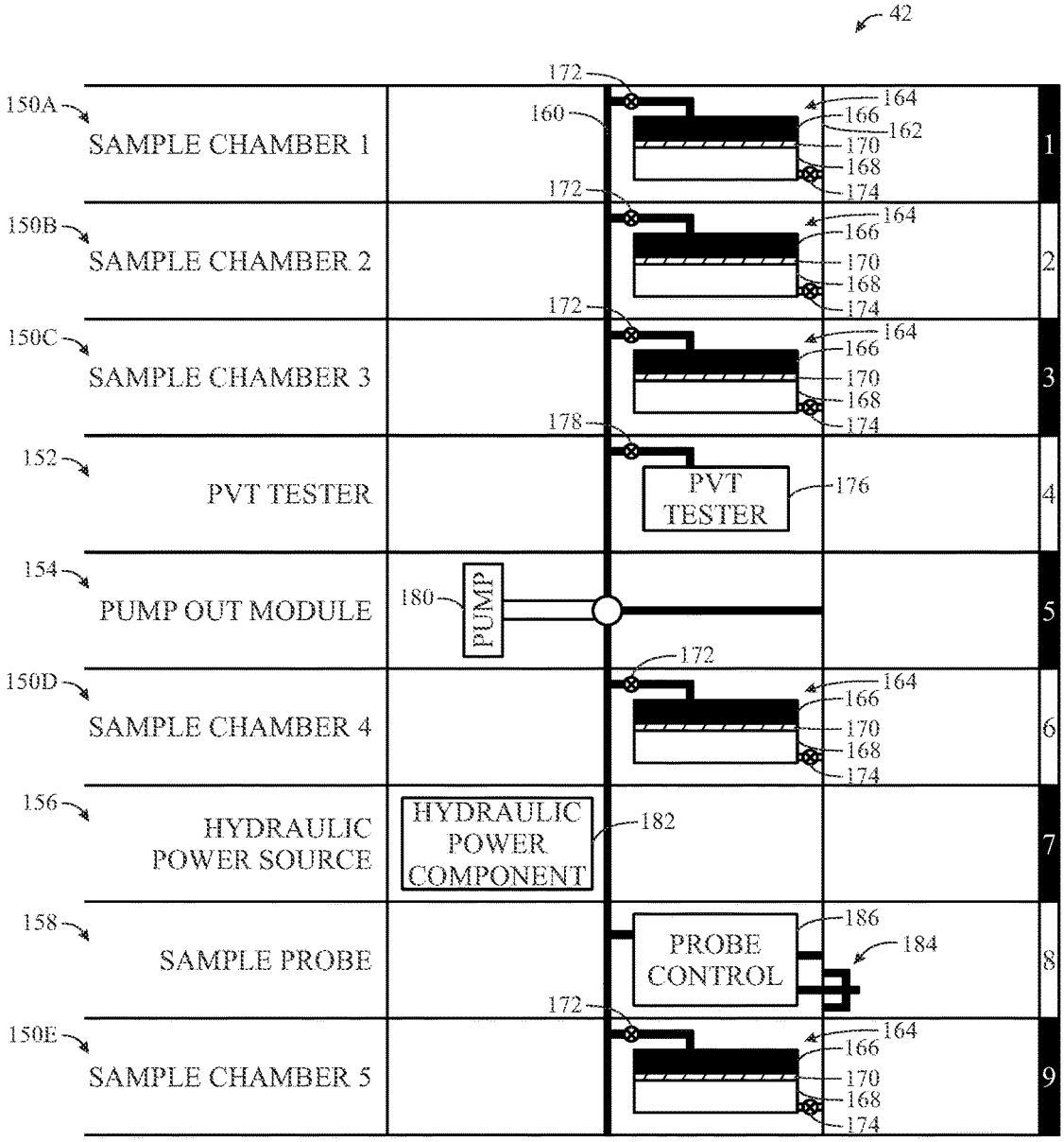
FIG. 4 is an example of a downhole acquisition tool, in accordance with an embodiment.

The sampling system 42 of the downhole acquisition tool 12 may take a variety of suitable forms. In general, the sampling system 42 may be part of any suitable formation fluid testing or sampling tool that can store fluid samples from two different stations and mix the fluid for testing. In the example of FIG. 4, the sampling system 42 includes several sample chambers: 150A ("Sample Chamber 1"), 150B ("Sample Chamber 2"), 150C ("Sample Chamber 3"), 150D ("Sample Chamber 4"), and 150E ("Sample Chamber 5"), though it should be appreciated that more or fewer sample chambers 150 may be used in the sampling system 42. The sampling system 42 may also include a pressure-volume-temperature (PVT) tester 152 section, a pump-out module 154 section, a hydraulic power source 156 section, and a sample probe 158 section.

Each of the sample chambers 150 may be tied to a front flowline 160 and back flowline 162. A volume 164 may include a front volume 166, a back volume 168, and a dividing piston 170 that separates the front volume 166 from the back volume 168. Fluid may enter the front volume 166 through a valve 172 and via the front flowline 160. Fluid may enter or exit the back volume 168 from the back flowline 162 via a valve 174. It should be appreciated that, in certain examples, just the valve 172 or just the valve 174 may be used for each sample chamber 150 section. The valves 172 and 174 may be seal valves, check valves, flow restrictors (e.g., constant flow rate or variable flow rate), relief valves, or some combination of these types of valves. In certain examples, the valves 172 and 174 may include a motor seal valve that can throttle the flow of fluids through the components, or any other device that may control or restrict the flow of fluid through it. Each of the volume chambers 164 may have any suitable size (e.g., 1 gallon, 2.75 gallons, 6 gallons, and so forth).

The PVT tester 152 section may include a PVT tester component 176, acts a fluidity access to which is controlled by a valve 178. As in regarding the valve 172 and 174, the valve 178 may be seal valves, check valves, flow restrictors (e.g., constant flow rate or variable flow rate), relief valves, or some combination of these types of valves. The PVT tester component 176 may represent any suitable device that can control the pressure of the fluid controlled within to test for fluid properties that indicate when a phase envelope boundary has been crossed. For example, the PVT tester component 176 may include a micropiston to maintain, increase, or decrease the pressure inside the PVT tester component 176 while the fluid properties such as the optical density of the fluid are measured. By monitoring the fluid properties as the pressure changes, the phase envelope boundaries may be identified.

In one example, the PVT tester component 176 may collect and analyzing a small sample with equipment with a small interior volume allows for precise control and rigorous observation when the equipment is appropriately tailored for measurement, as described by Application No. PCT/US2014/015467, which, as noted above, is incorporated by reference herein in its entirety for all purposes. At elevated temperatures and pressures, the equipment may also be configured for effective operation over a wide temperature range and at high pressures. Selecting a small size for the equipment may permit rugged operation because the heat transfer and pressure control dynamics of a smaller volume of fluid are easier to control than those of large volumes of liquids. That is, a system with a small exterior volume may be selected for use in a modular oil field services device for use within a wellbore. A small total interior volume can also allow cleaning and sample exchange to occur more quickly than in systems with larger volumes, larger surface areas, and larger amounts of dead spaces. Cleaning and sample exchange are processes that may influence the reliability of the phase transition cell. That is, the smaller volume uses less fluid for observation, but also can provide results that are more likely to be accurate.

The PVT tester component 176 may measure the saturation pressure of a representative reservoir fluid sample at the reservoir temperature. In a surface measurement, the reservoir phase envelope may be obtained by measuring the saturation pressure (bubble point or dewpoint pressures) of the sample using a traditional pressure-volume-temperature (PVT) view cell over a range of temperatures. At each temperature, the pressure of a reservoir sample is lowered while the sample is agitated with a mixer. This is done in a view cell until bubbles or condensate droplets are optically observed and is known as a Constant Composition Expansion (CCE). The PVT view cell volume is on the order of tens to hundreds of milliliters, thus using a large volume of reservoir sample to be collected for analysis. This sample can be consumed or altered during PVT measurements. A similar volume may be used for each additional measurement, such as density and viscosity, in a surface laboratory. By contrast, the PVT tester component 176 may use a small volume of fluid used by microfluidic sensors (e.g., approximately 1 milliliter total for the measurements described herein) to make measurements.

In one or more embodiments, an optical phase transition cell may be included in a PVT tester component 176. It may be positioned in the fluid path line to subject the fluid to optical interrogation to determine the phase change properties and its optical properties. U.S. patent application Ser. No. 13/403,989, filed on Feb. 24, 2012 and United States Patent Application Publication Number 2010/0265492, published on Oct. 21, 2010 describe embodiments of a phase transition cell and its operation. Both of these applications are incorporated by reference herein for all purposes in their entirety. The pressure-volume-temperature phase transition cell may contain as little as 300 μl of fluid. The phase transition cell detects the dew point or bubble point phase change to identify the saturation pressure while simultaneously nucleating the minority phase.

The phase transition cell may provide thermal nucleation which facilitates an accurate saturation pressure measurement with a rapid depressurization rate of from about 10 to about 100 psi/second. As such, a saturation pressure measurement (including depressurization from reservoir pressure to saturation pressure) may take place in less than 10 minutes, as compared to the saturation pressure measurement via standard techniques in a surface laboratory, wherein the same measurement may take several hours.

Some embodiments may include a view cell to measure the reservoir asphaltene onset pressure (AOP), wax appearance temperature (WAT), as well as the saturation pressure (PSAT) phase envelopes. Hence, the phase transition cell becomes a configuration to facilitate the measurement of many types of phase transitions.

Moreover, in one or more embodiments, a densitometer, a viscometer, a pressure gauge and/or a method to control the sample pressure with a phase transition cell may be integrated so that most sensors and control elements operate simultaneously to fully characterize a live fluid's saturation pressure. In some embodiments, each individual sensor itself has an internal volume of no more than 20 microliters (approximately 2 drops of liquid) and by connecting each in series, the total volume (500 microliters) to charge the system with live oil before each measurement may be minimized. In some embodiments, the fluid has a total fluid volume of about 1.0 mL or less. In other embodiments, the fluid has a total fluid volume of about 0.5 mL or less.

A micropiston or piston (e.g., a sapphire piston) may control the pressure within the PVT tester component 176. In such an embodiment, the control of the pressure in the system may be adjusted by moving the piston to change the volume inside the piston housing and, thus, the sample volume. The PVT tester component 176 may have a relatively small dead volume (e.g., less than 0.5 mL) to facilitate pressure control and sample exchange. In some embodiments, the depressurization or pressurization rate of the fluid may be less than 100 psi/second. In some embodiments, the fluid is circulated through the system at a volumetric rate of no more than 1 ml/sec. Teflon, alumina, ceramic, zirconia or metal with seals may be selected for some components for various embodiments of the pressure control device. Smooth hard surfaces may be used to minimize friction of the moving piston and both energized and dynamic seals may be used.

Using the PVT tester component 176, temperature and pressure measurements for phase envelopes of the formation fluids 50 may be obtained. In general, the temperature of the fluids analyzed by the PVT tester component 176 may be substantially ambient to the depth of the wellbore 14. Thus, in general, the deeper the downhole acquisition tool 12, the higher the temperature. The PVT tester component 176 thus may be used to obtain temperature and pressure measurements of the phase envelopes of the formation fluids 50 at different temperatures by moving the downhole tool 12 to different depths and obtaining new phase envelope measurements at the different temperatures at those depths. This may allow the downhole acquisition tool 12 to obtain a more complete set of temperature and pressure data points that describe the phase envelopes of the formation fluids 50.

The pump-out module 154 may include a fluid pump 180 to create a pressure differential to cause fluid to flow through the flowlines 160 and/or 162. For example, the pump 180 may include an electromechanical pump used for pumping obtained fluids 52 (e.g., formation fluid 50) into the sample chambers 150 or out of the sampling system 42. The pump 180 may operate as a piston displacement unit (DU) driven by a ball screw coupled to a gear box and electric motor, although any suitable pumps may be used. Power to the pump 180 may come from a hydraulic power component 182 in the hydraulic power source 156 section of the downhole acquisition tool 12. The hydraulic power component 182 may include a power generation module that contains an electric motor and a hydraulic pump to provide hydraulic power for the various components of the downhole acquisition tool 12. In one example, an electric power cartridge may convert alternating currents (AC) electric power from the surface to provide direct current (DC) for the modules of the downhole acquisition tool 12.

The sample probe 158 section may include a probe 184 that forms an extendable fluid communication line that engages the geological formation 20 and communicates formation fluid into the downhole acquisition tool 12. In one example, the probe 184 includes a rubber "donut" that extends from the sample probe 158 section to engage the wellbore wall. The formation fluid may be pumped into the downhole acquisition tool through a fluid inlet of the probe 184 through a probe control block 186 that may include valves and continuants to direct the formation fluid to the front flowline 160 or the back flowline 162.

Figure 5A:
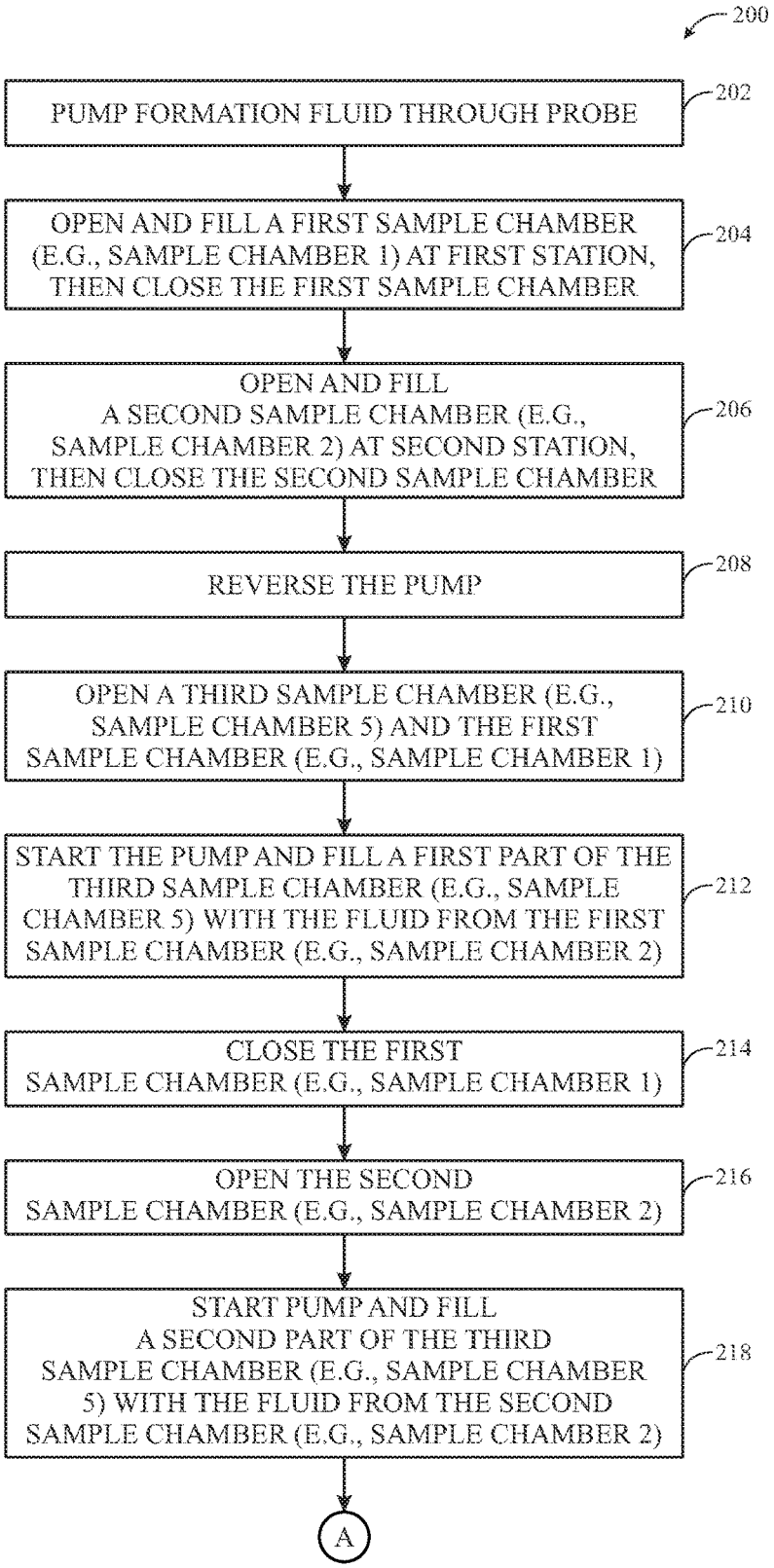
FIGS. 5A and 5B illustrate a flowchart of a method for using the downhole acquisition tool of FIG. 4 to identify the compatibility of formation fluids from two different stations in the well, in accordance with an embodiment.
Figure 5B:
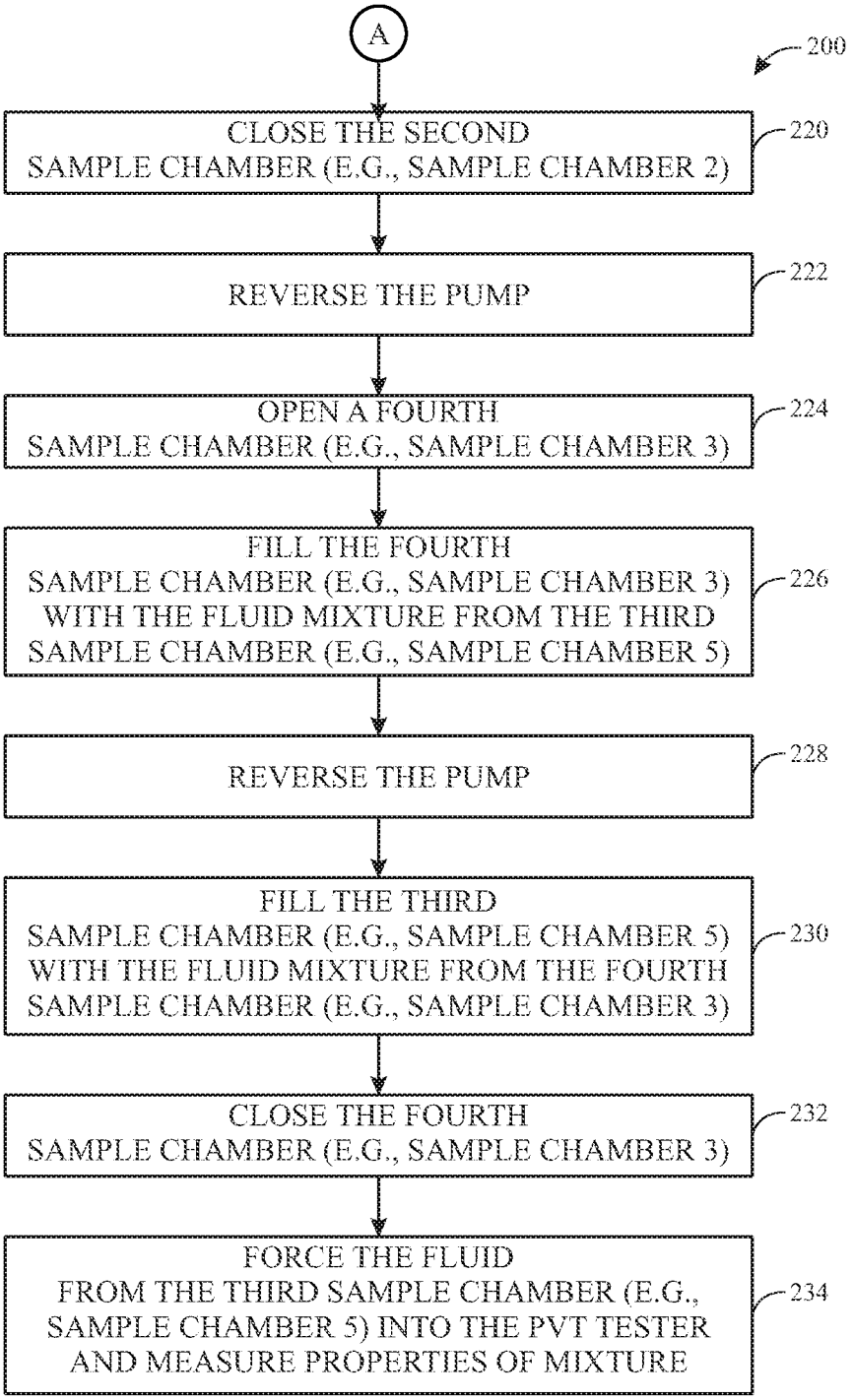
Figure 6:
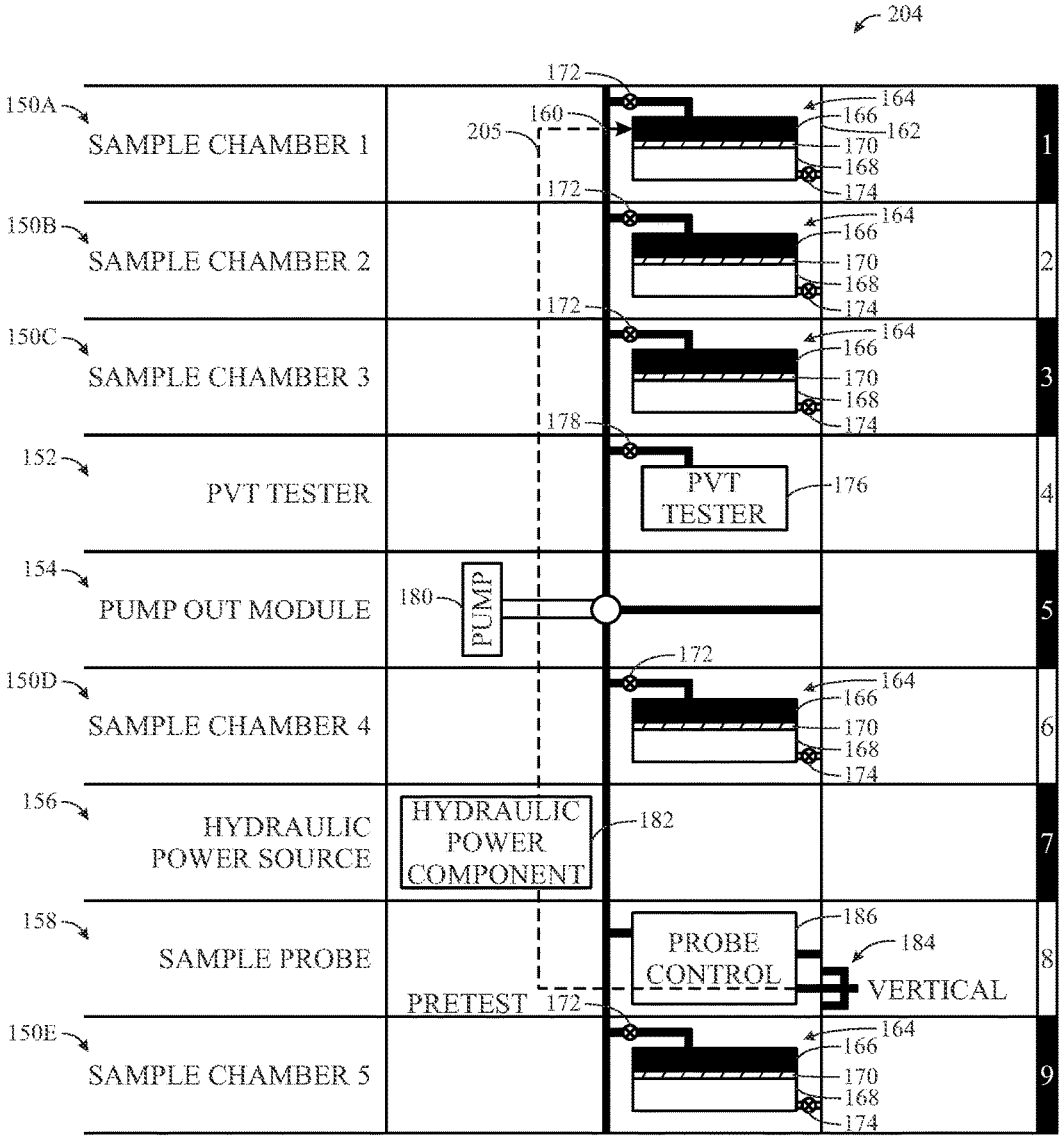
FIGS. 6-12 are schematic diagrams representing fluid flow through the downhole acquisition tool in the method of FIGS. 5A and 5B.
Figure 7:
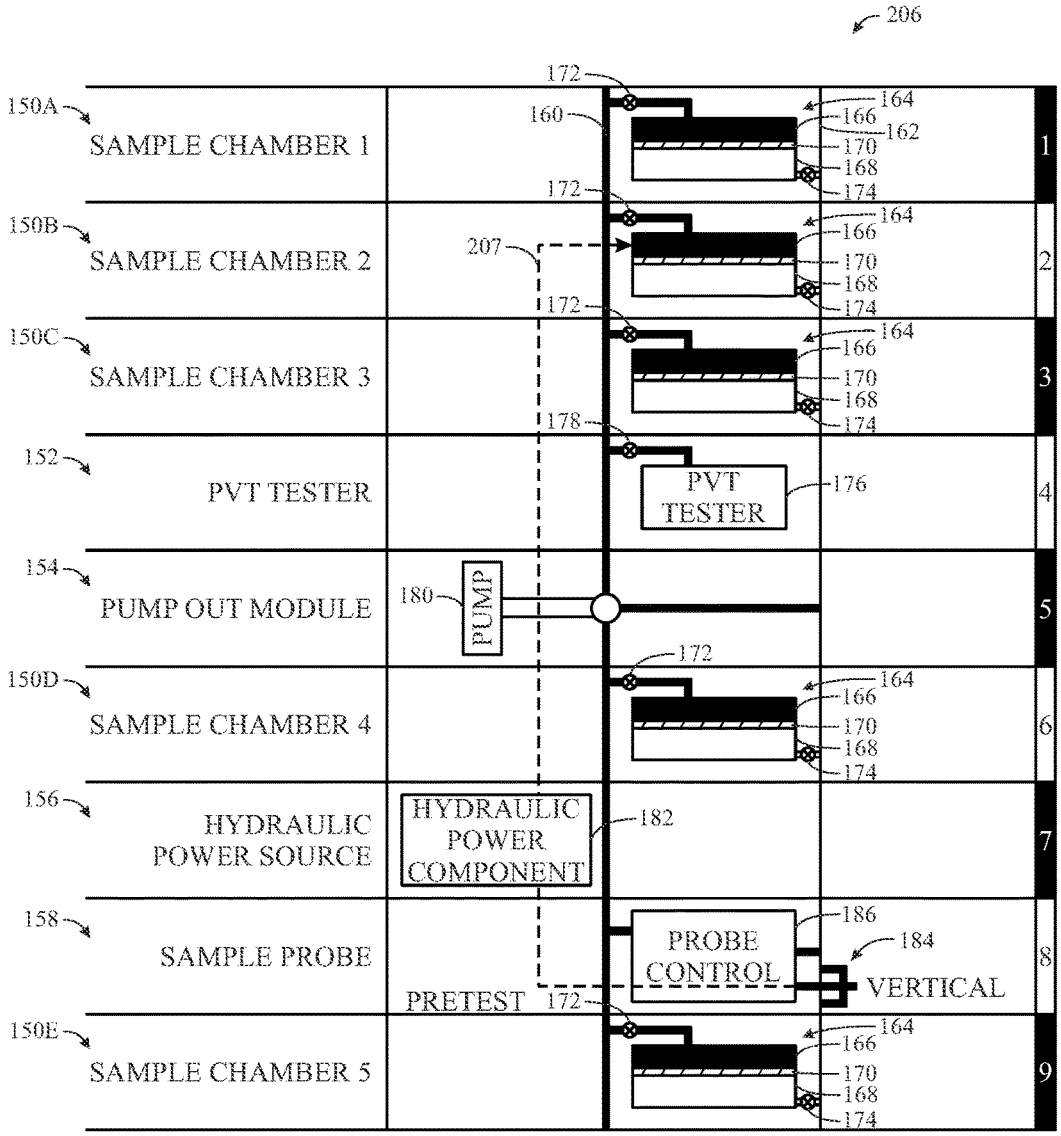

A flowchart 200 of FIGS. 5A and 5B represents one manner in which the sampling system 42 shown in FIG. 4 may be used to identify the compatibility of formation fluids 50 from different stations. Formation fluid 50 may be pumped through the probe 184 (block 202). At a first station, the formation fluid 50 may be collected in a first sample chamber 150 (e.g., "Sample Chamber 1") (block 204), as shown by fluid flow 205 depicted in FIG. 6. The formation fluid 50 obtained at block 204 of FIG. 5A may be obtained, for example, from the first fluid zone 51A. After obtaining the sample of the formation fluid 50 at the first station, the downhole acquisition tool 12 may be moved to a second station and a second sample chamber 150 (e.g., "Sample Chamber 2") may be filled with the formation fluid 50 from the second station (block 206), as shown by fluid flow 207 depicted in FIG. 7. If desired, additional formation fluids 50 from additional stations may be obtained and stored in other sample chambers 150 in a similar manner.

Figure 8:
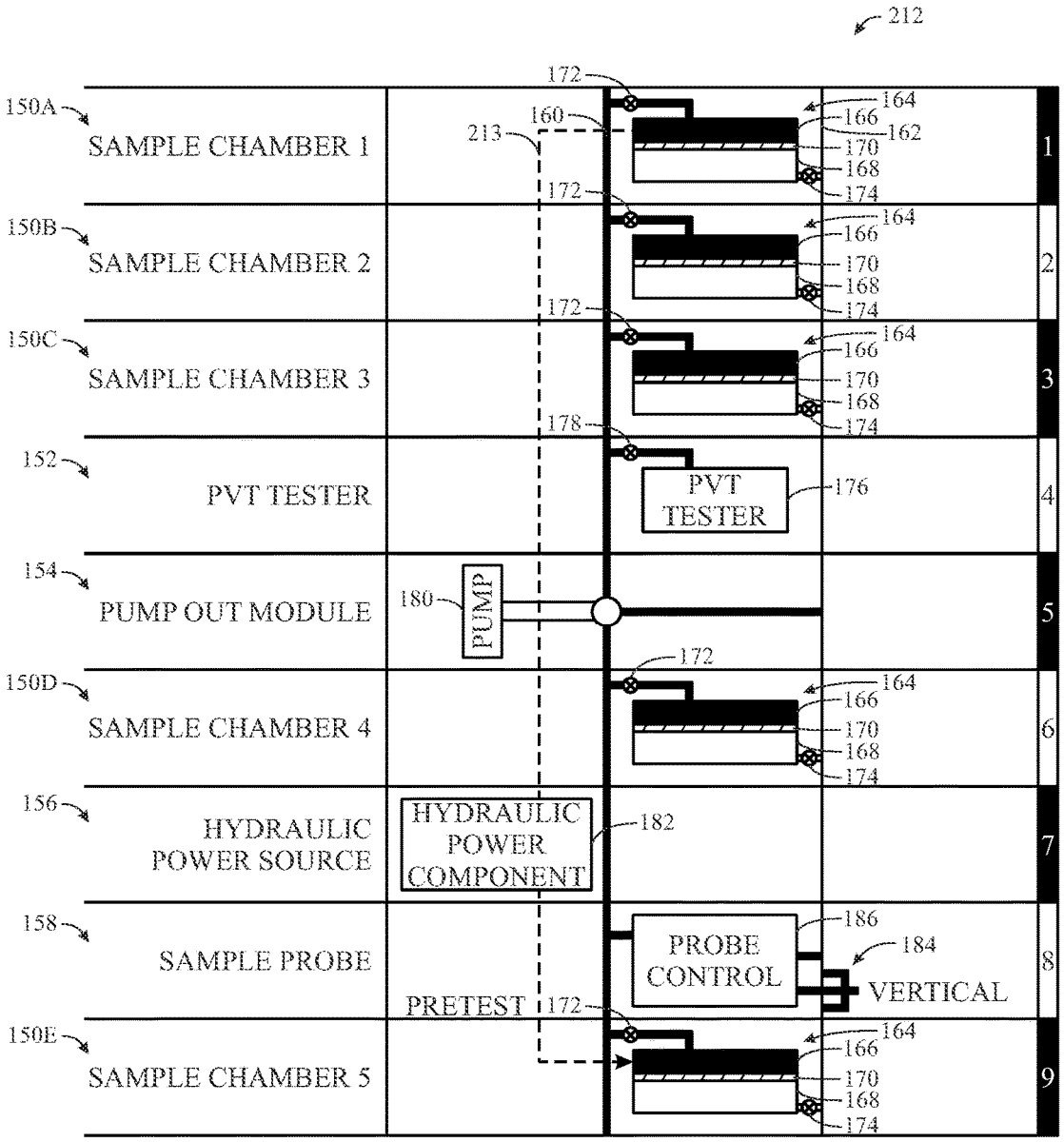

With continued reference to FIG. 5A, the direction of fluid flow through the pump 180 may be reversed (block 208) to allow some of the formation fluids 50 stored in the first and second sample chambers 150 to be moved into a different shared sample chamber 150. For example, a third sample chamber 150 (e.g., "Sample Chamber 5") on the other side of the pump 180 may be opened along with the first sample chamber 150 (e.g., "Sample Chamber 1") (block 210). The pump 180 may pump some of the formation fluid 50 stored in the first sample chamber 150 (e.g., "Sample Chamber 1") into the third sample chamber 150 (e.g., "Sample Chamber 5"), as shown by fluid flow 213 depicted in FIG. 8.

Figure 9:
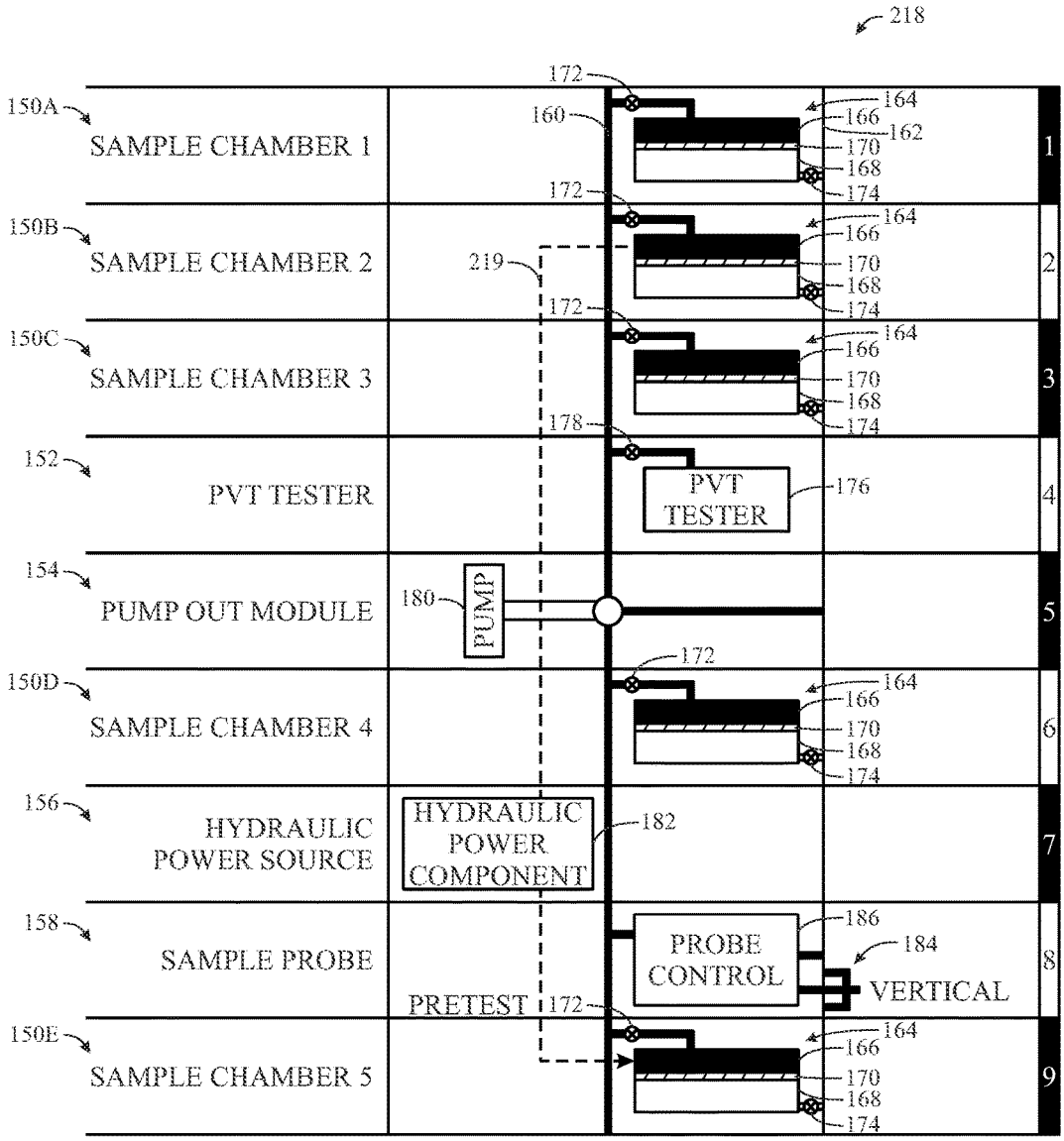

When a desired amount of the formation fluid 50 from the first station has been stored into the third sample chamber 150 (e.g., "Sample Chamber 5"), the first sample chamber 150 (e.g., "Sample Chamber 1") may be closed (block 214) and the second sample chamber 150 (e.g., "Sample Chamber 2") may be opened (block 216). The pump 180 may pump some of the formation fluid 50 out of the second sample chamber 150 (e.g., "Sample Chamber 2") into the third sample chamber 150 (e.g., "Sample Chamber 5") (block 218), as shown by fluid flow 219 depicted in FIG. 9. Continuing to FIG. 5B, when a desired amount of the formation fluid 50 from the second station has been stored into the third sample chamber 150 (e.g., "Sample Chamber 5"), the second sample chamber 150 (e.g., "Sample Chamber 2") may be closed (block 220) and the pump 180 may be reversed (block 222).

Figure 10:
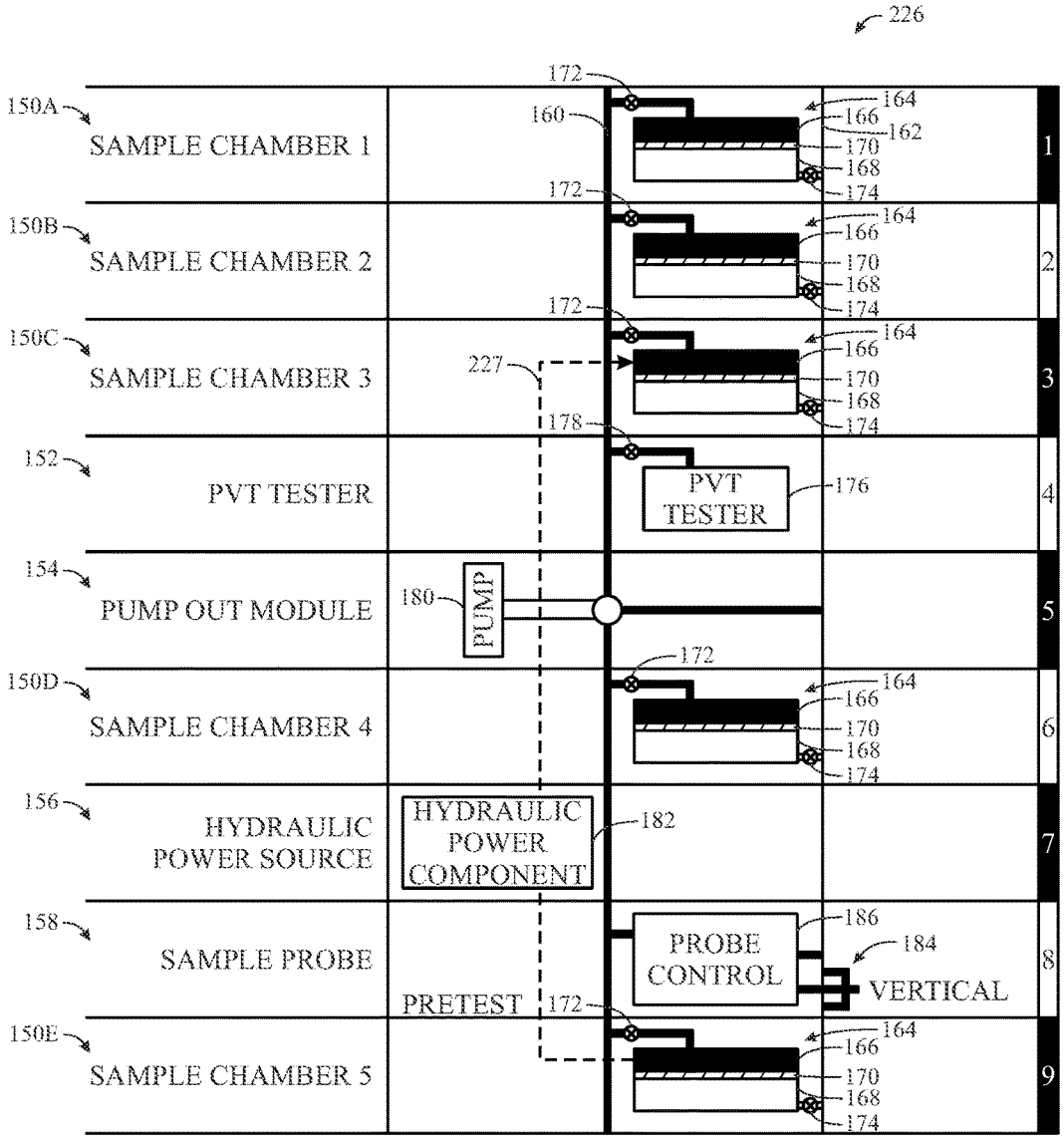
Figure 11:
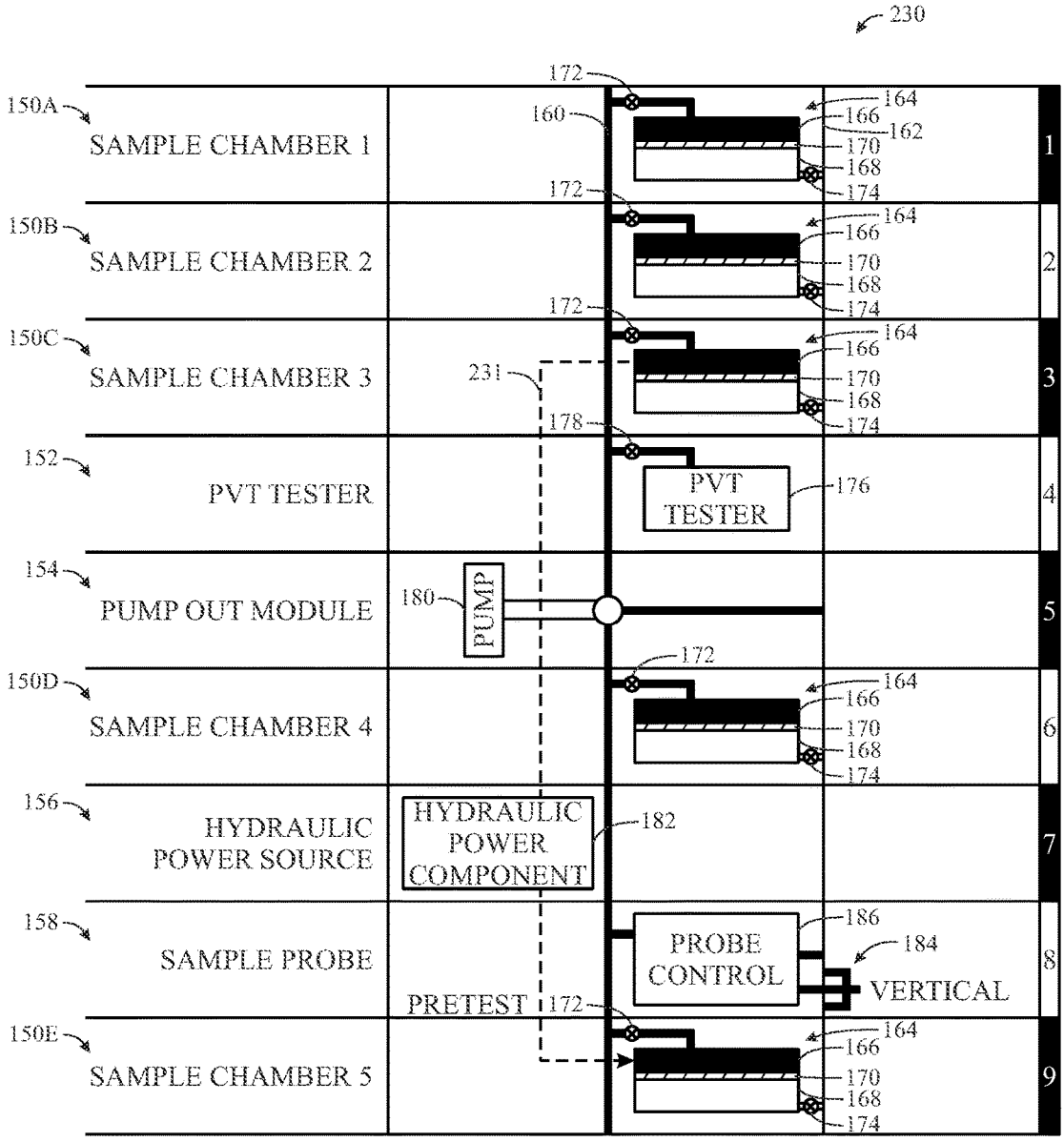

At this point, the third sample chamber 150 (e.g., "Sample Chamber 5") may hold a mix of formation fluids 50 from both the first and second stations. If desired, this mixture of formation fluids 50 stored in the third sample chamber 150 (e.g., "Sample Chamber 5") may be pumped directly to the PVT tester component 176 for fluid analysis. It is possible, however, that the formation fluids 50 from the first and second stations may not be fully mixed inside the third sample chamber ("Sample Chamber 5"). As such, a fourth sample chamber 150 (e.g., "Sample Chamber 3") may be opened on the other side of the pump 180 (block 224). The pump 180 may pump the contents of the third sample chamber 150 (e.g., "Sample Chamber 5") into the fourth sample chamber 150 (e.g., "Sample Chamber 3") (block 226), as shown by fluid flow 227 depicted in FIG. 10. This may cause the mixture of the formation fluids 50 from the different stations to mix further. Additional mixing may occur as the pump 180 is reversed (block 228) and the contents of the fourth sample chamber 150 (e.g., "Sample Chamber 3") are pumped by the pump 180 back into the third sample chamber 150 (e.g., "Sample Chamber 5") (block 230), as shown by fluid flow 231 depicted in FIG. 11. The fourth sample chamber 150 (e.g., "Sample Chamber 3") may be closed (block 232).

Figure 12:
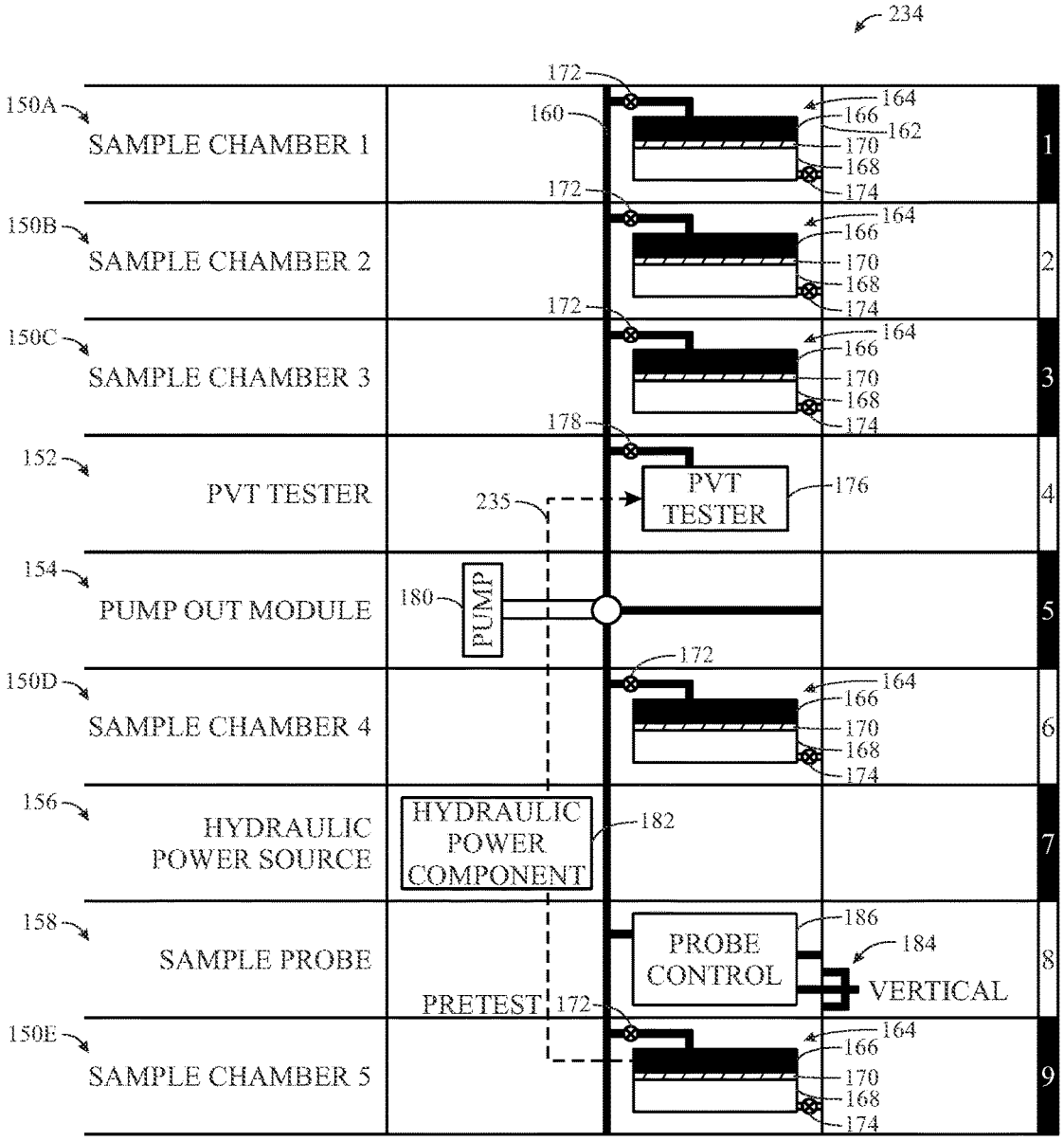

The pump 180 may force the mixture of formation fluids 50 from the first and second stations, now well mixed in the third sample chamber 150 (e.g., "Sample Chamber 5"), into the PVT tester component 176 (block 234), as shown by fluid flow 235 depicted in FIG. 12. The PVT tester component 176 may obtain measurements relating to the saturation pressure (PSAT), wax appearance temperature (WAT), and/or asphaltene onset pressure (AOP) of the fluid mixture. Other fluid properties of the mixed fluid may also be obtained in-situ, including fluid viscosity, density, composition, gas-to-oil ratio (GOR), differential vaporization, and so forth. As noted above, by obtaining the properties of the formation fluids 50 from different stations in-situ, properties of the mixed fluid as the fluids actually behave in the downhole environment may be determined. The in-situ measurements of the mixture of the formation fluids 50 may be used as an alternative or in addition to estimates of mixed-fluid properties based on individual measurements or measurements made in a laboratory by mixing the formation fluids 50 at the surface. For example, the remaining fluids in the first sample chamber 150 (e.g., "Sample Chamber 1") and the second sample chamber 150 (e.g., "Sample Chamber 2") may be brought to the surface for further analysis, which may include mixing the fluids together in a laboratory setting to corroborate the in-situ measurement.

Figure 13:
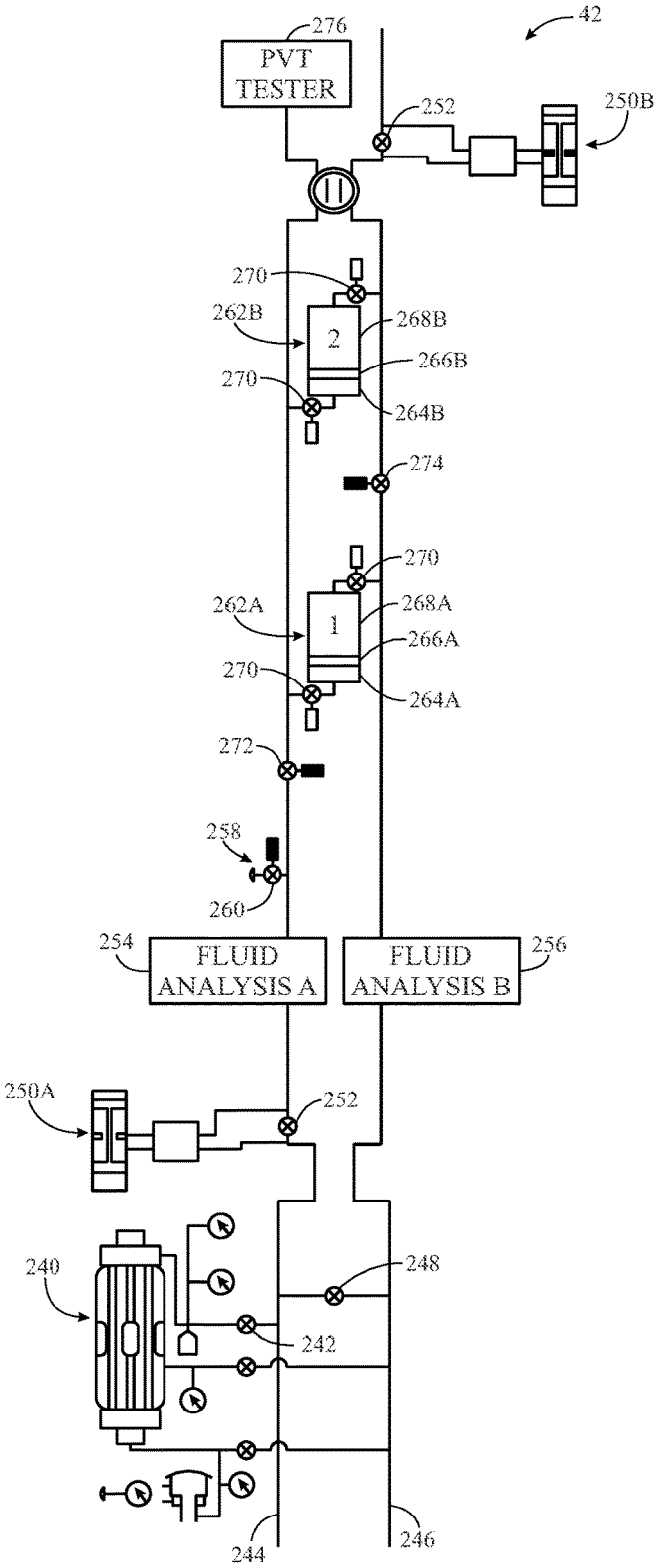
FIG. 13 is another example of a downhole acquisition tool, in accordance with an embodiment.

Another example of a sampling system 42 of the downhole acquisition tool 12 is shown in FIG. 13. The sampling system 42 shown in FIG. 13 includes a probe 240 that may communicably couple to the wellbore wall to obtain formation fluid 50 from the formation 20. In the example shown in FIG. 13, the probe 240 is an inflatable packer. Formation fluid 50 may pass through an interval valve 242 onto a front flowline 244. A back flowline 246 may be separated from the front flowline 244 by a comingle valve 248. When the comingle valve 248 is closed, the front flowline 244 and the back flowline 246 may be out of fluid communication with each other within the sampling system 42. When the comingle valve 248 is open, fluids from the front flowline 244 may enter the back flowline 246, and vice-versa.

The sampling system 42 shown in FIG. 13 also includes a lower pump 250A and an upper pump 250B. The lower pump 250A is located along the front flowline 244 and the upper pump is located along the back flowline 246. Respective bypass valves 252 may be opened or closed to cause the pumps 250A or 250B to be bypassed. Various fluid analysis components may analyze the fluid flowing in the downhole acquisition tool 12. For instance, a first fluid analysis component 254 ("Fluid Analysis A") may perform various fluid analysis's on the front flowline 244. A second fluid analysis component 256 ("Fluid Analysis B") may perform various fluid analysis's on the back flowline 246. For instance, the first fluid analysis component 254 may conduct optical and/or density analysis, while the second fluid analysis component 256 may perform a density measurement. An exit port 258 may selectively provide fluid communication with the wellbore 14 by opening a valve 260.

At least two volume chambers 262 may appear in the sampling system 42 shown in FIG. 13. A first volume chamber 262A ("Sample Chamber 1") includes a front volume 264A, a separating piston 266A, and a back volume 268A. A second volume chamber 262B ("Sample Chamber 2") likewise includes a front volume 264B, a dividing piston 266B, and a back volume 268B. Various valves 270 may provide access to the front volume chambers 264 and/or the back volume chambers 268. In other examples, the valves 270 may appear on one side rather than both sides of the volume chambers 262. For example, the valves 270 may directly couple the front volume chambers 264 to the front flowlines 244, but the back volume chambers 268 may couple directly to the back flowline 246 without any valves 270.

The example of the downhole acquisition tool 12 of FIG. 13 also includes a first flowline valve 272 and a second flowline valve 274. A PVT tester 276 is coupled to the front flowline 244. As will be discussed below, the first flowline valve 272 and the second flowline valve 274 may be used to control the mixing of formation fluids 50 from different stations. The PVT tester 276 may operate in a substantially similar manner to the PVT tester component 176.

Figure 14:
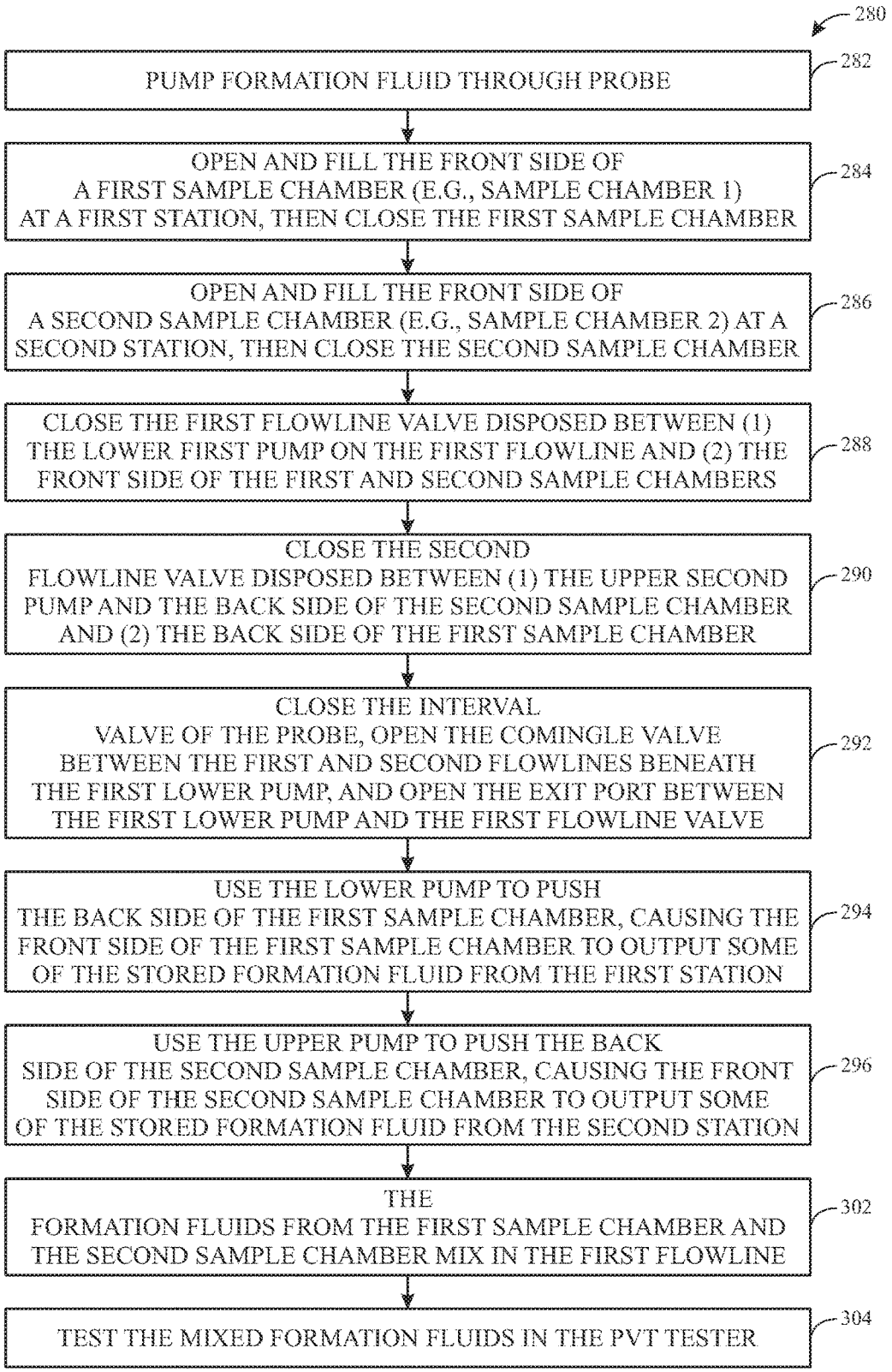
FIG. 14 is a flowchart of a method for using the downhole acquisition tool of FIG. 13 to identify the compatibility of formation fluids from two different stations in the well, in accordance with an embodiment.
Figure 15:
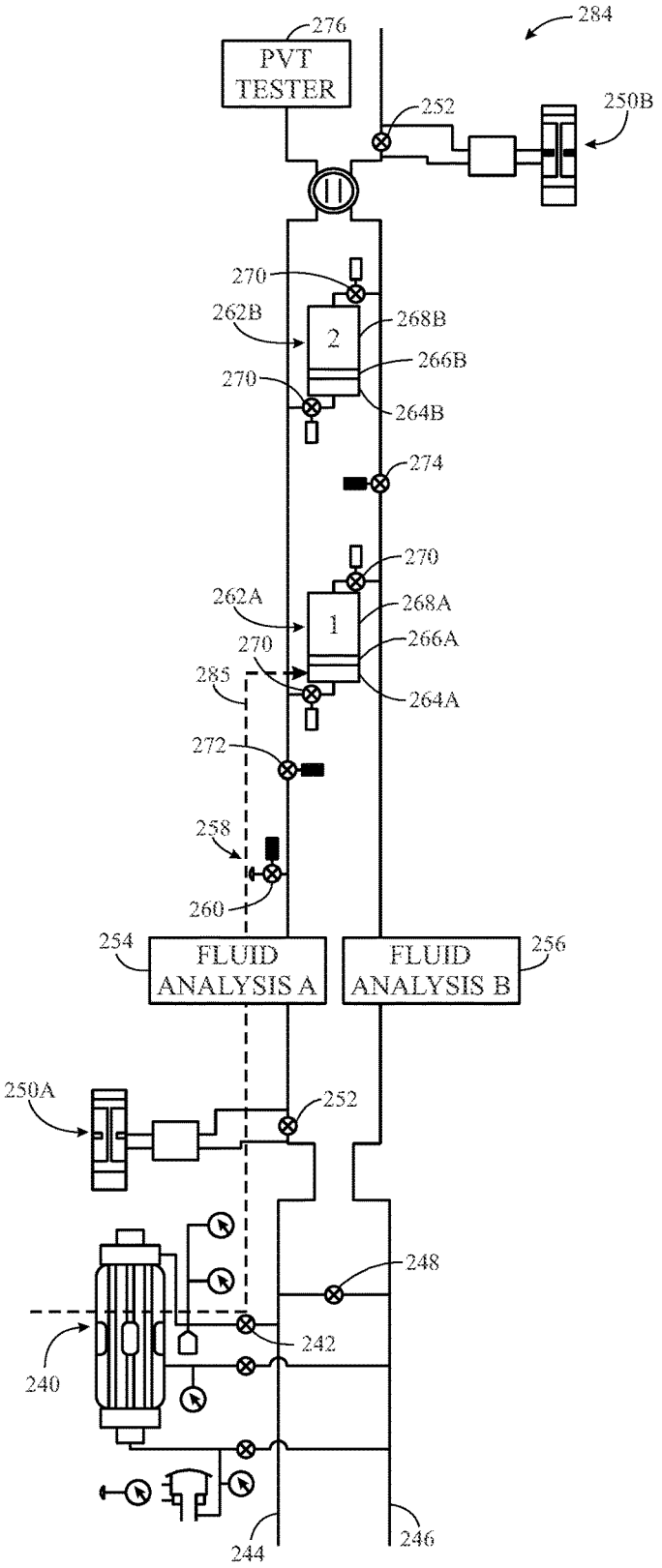
FIGS. 15-17 are schematic diagrams representing fluid flow through the downhole acquisition tool in the method of FIG. 14.

A flowchart 280 shown in FIG. 14 describes one manner in using the sampling system 42 of FIG. 13. Formation fluid 50 may be pumped through the probe 240 (block 282). At a first station, such as a depth within the first fluid zone 51A, a first sample chamber 262 (e.g., sample chamber 262A) may be opened by opening the valves 270 attached to the first sample chamber 262A. The formation fluid 50 may be pumped into a front volume 264A of the first sample chamber 262A (block 284 of FIG. 14), as shown by fluid flow 285 of FIG. 15. The first sample chamber 262A may be closed once the formation fluid 50 has been stored by closing the valves 270 attached to the first sample chamber 262A.

Figure 16:
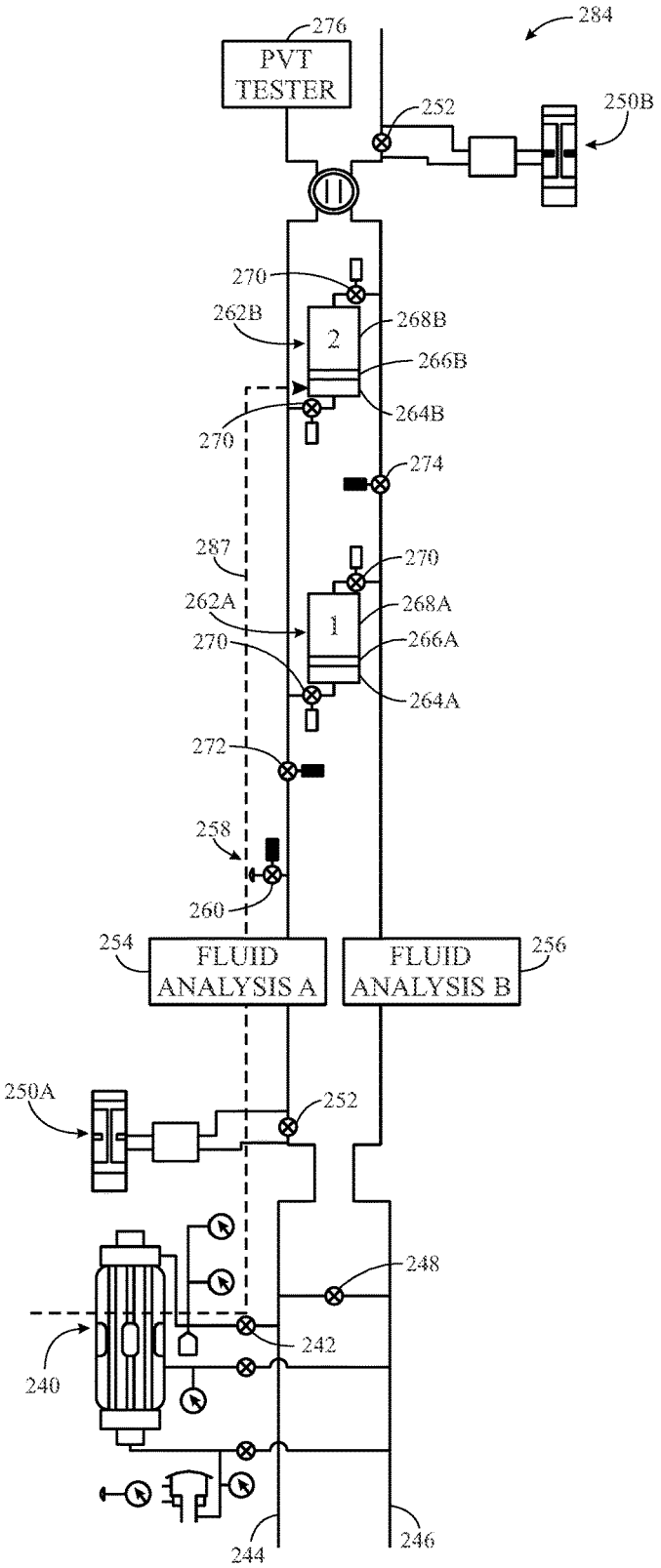

At a second station, such as at a depth within the second fluid zone 51B, a second sample chamber 262 (e.g., sample chamber 262B) may be opened by opening the valves 270 attached to the second sample chamber 262B. The formation fluid 50 may be pumped into a front volume 264B of the first sample chamber 262B (block 286 of FIG. 14), as shown by fluid flow 287 of FIG. 16. The second sample chamber 262B may be closed once the formation fluid 50 has been stored by closing the valves 270 attached to the second sample chamber 262B. Although blocks 284 and 286 describe filling the sample chamber 262A before the sample chamber 262B, it may be appreciated that these sample chambers 262 may be filled in reverse order.

Although the first flowline valve 272 and the second flowline valve 274 may both be open while the samples are collected into the sample chambers 262A and 262B, these may be closed to enable the formation fluids 50 to be mixed and tested. In particular, with continued reference to FIG. 15, the first flowline valve 272 may be closed (block 288)

and the second flowline valve 274 may be closed (block 290), and the interval valve 242 may be closed and the comingle valve 248 may be opened (block 292). This may allow the lower pump 250A to pump external fluid from outside the wellbore 14 through the exit port 258 through the comingle valve 248 and into the second flowline 246. The external fluid operates as a force fluid that is pressed into the back volume 268A of the first sample chamber 262A, thereby forcing fluid out of the front volume 264A of the first sample chamber 262A (block 294). At the same time, the upper pump 250B may be used to push fluid operating as a force fluid into the back volume 268B of the second sample chamber 262B, thereby forcing fluid out of the front volume 264B of the second sample chamber 262B (block 296).

Figure 17:
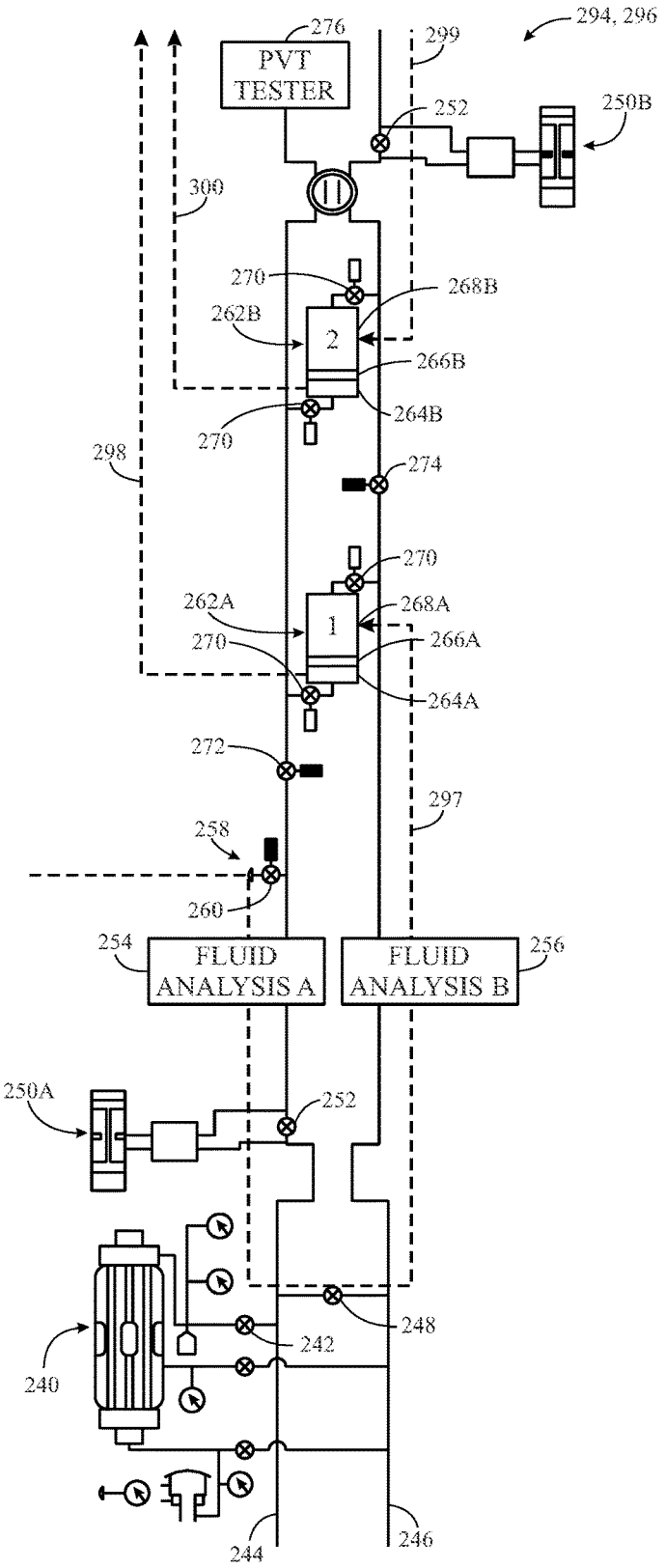

Fluid flow examples for blocks 294 and 296 of FIG. 14 are shown in FIG. 17. In particular, fluid flow 297 illustrates the flow of the force fluid pushed by the lower pump 250A into the back volume 268A of the first sample chamber 262A, which thereby causes fluid flow 298 as the stored formation fluid 50 from the first station is pushed out of the front volume 264A of the first sample chamber 262A. At the same time, fluid flow 299 illustrates the flow of the force fluid pushed into the back volume 268B of the sample chamber 262B, which thereby causes fluid flow 300 as the stored formation fluid 50 from the second station is pushed out of the front volume 264B of the second sample chamber 262B. The formation fluids 50 from the different stations thus mix in the first flowline 244 (block 302 of FIG. 14) as the mixture enters the PVT tester 276 (block 304 of FIG. 14).

Since the first flowline valve 272 prevents the formation fluids exiting the sample chambers 262A and 262B from exiting down the front flowline 244, the fluids instead are forced into the PVT tester 276. As may be appreciated from the fluid flow diagram of FIG. 17, by controlling the respective flow rates through the lower pump 250A and upper pump 250B, the corresponding flow rates of the formation fluids 50 from the first sample chamber 262A and the second sample chamber 262B—as illustrated by fluid flows 298 and 300—may be controlled to achieve a desired mixing ratio. For example, if the flow rate through the first lower pump 250A and the flow rate from the upper pump 250B are equal, the proportion of the mixture of the formation fluids 50 from the two sample chambers 262A and 262B may be approximately equivalent, producing a roughly half/half mixture. On the other hand, if the flow rate through the lower pump 250A is twice that of the upper pump 250B, the resulting proportion of the mixed formation fluids 50 that enter the PVT tester 276 may be approximately 2:1 from the first station in relation to the second station. Thus, by adjusting the flow rates of the pumps 250A and 250B, the desired proportion of mixture of formation fluids 50 may be created in-situ.

Figure 18:
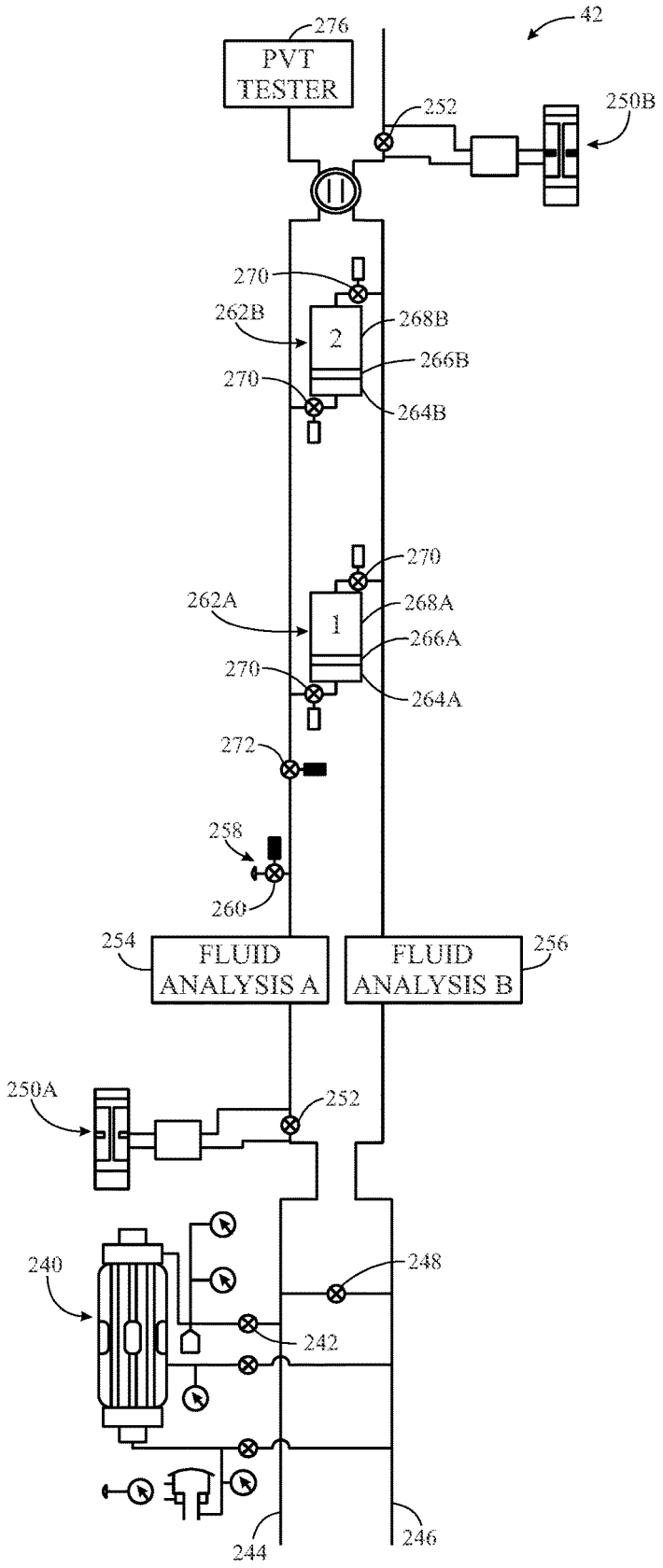
FIG. 18 is another example of a downhole acquisition tool, in accordance with an embodiment.

Another example of a sampling system 42 that may be used to perform in-situ measurements of formation fluids 50 from different stations is shown in FIG. 18. The sampling system 42 of FIG. 18 may be substantially the same as the sampling system 42 of FIG. 13, except that the second flowline valve 274 may not be used. As such, the sampling system 42 of FIG. 18 may represent an example of the sampling system 42 of FIG. 13 without the second flowline valve 274 or one in which the second flowline valve 274 remains open. Moreover, the upper pump 250B may or may not be used, as will be discussed further below.

Figure 19:
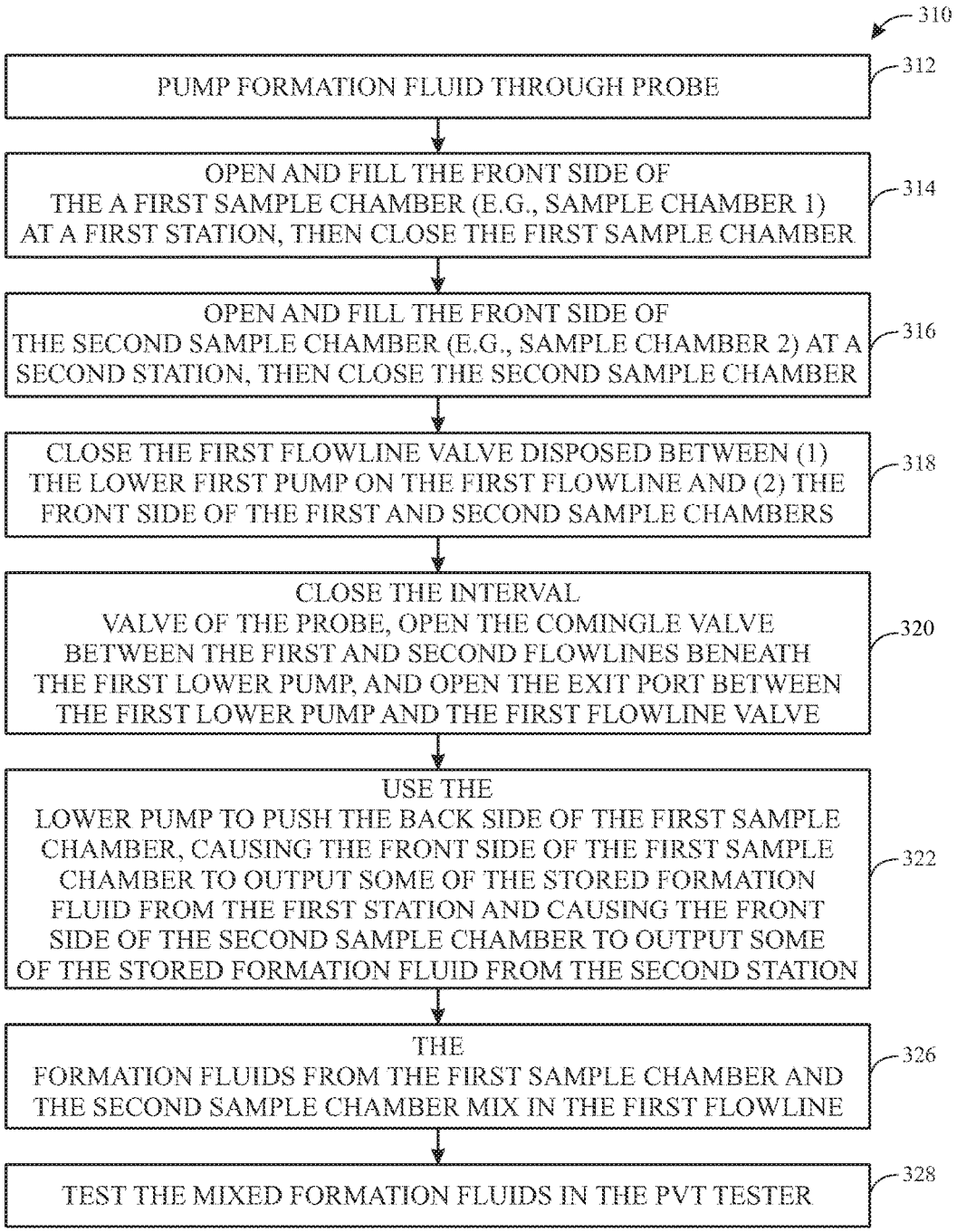
FIG. 19 is another flowchart of a method for using the downhole acquisition tool of FIG. 18 to identify the compatibility of formation fluids from two different stations in the well, in accordance with an embodiment.
Figure 20:
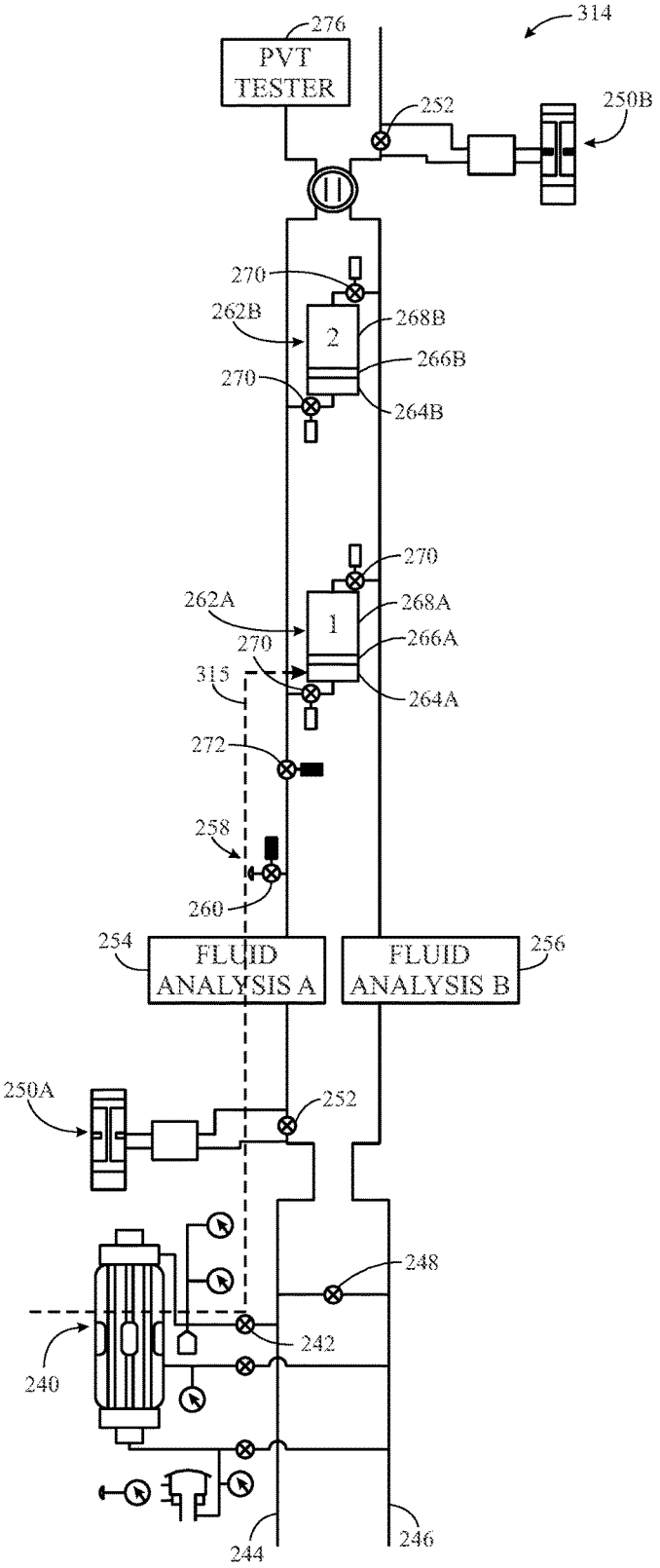
FIGS. 20-22 are schematic diagrams representing fluid flow through the downhole acquisition tool during the method of FIG. 19.

In one example, the sampling system 42 of FIG. 18 may be used to mix formation fluids 50 from different stations in a manner shown by a flowchart 310 of FIG. 19. For example, formation fluid 50 may be pumped through the probe 240 at certain stations (block 312). At a first station, such as a depth within the first fluid zone 51A, a first sample chamber 262 (e.g., sample chamber 262A) may be opened by opening the valves 270 attached to the first sample chamber 262A. The formation fluid 50 may be pumped into a front volume 264A of the first sample chamber 262A (block 314 of FIG. 19), as shown by fluid flow 315 of FIG. 20. The first sample chamber 262A may be closed once the formation fluid 50 has been stored by closing the valves 270 attached to the first sample chamber 262A.

Figure 21:
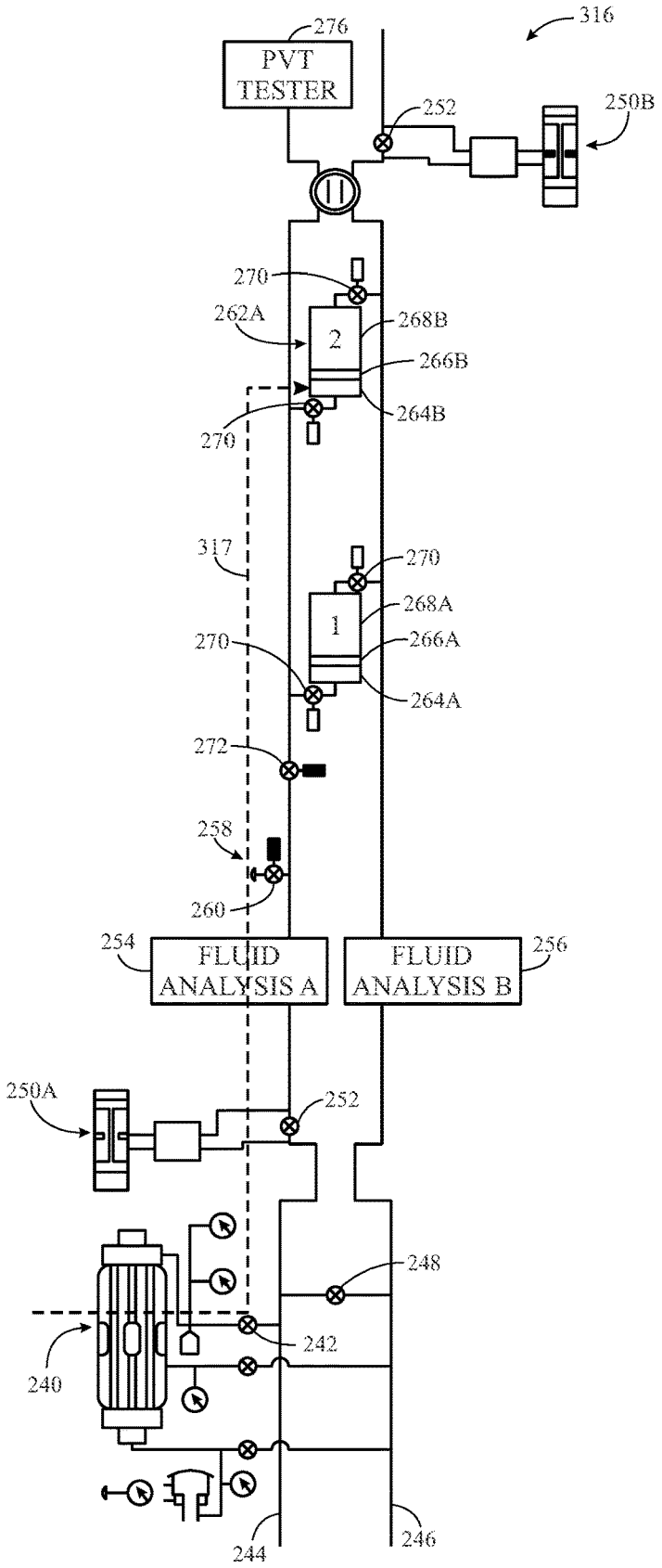

At a second station, such as at a depth within the second fluid zone 51B, a second sample chamber 262 (e.g., sample chamber 262B) may be opened by opening the valves 270 attached to the second sample chamber 262B. The formation fluid 50 may be pumped into a front volume 264B of the first sample chamber 262B (block 316 of FIG. 19), as shown by fluid flow 317 of FIG. 21. The second sample chamber 262B may be closed once the formation fluid 50 has been stored by closing the valves 270 attached to the second sample chamber 262B. Although blocks 314 and 316 describe filling the sample chamber 262A before the sample chamber 262B, it may be appreciated that these sample chambers 262 may be filled in reverse order.

Figure 22:
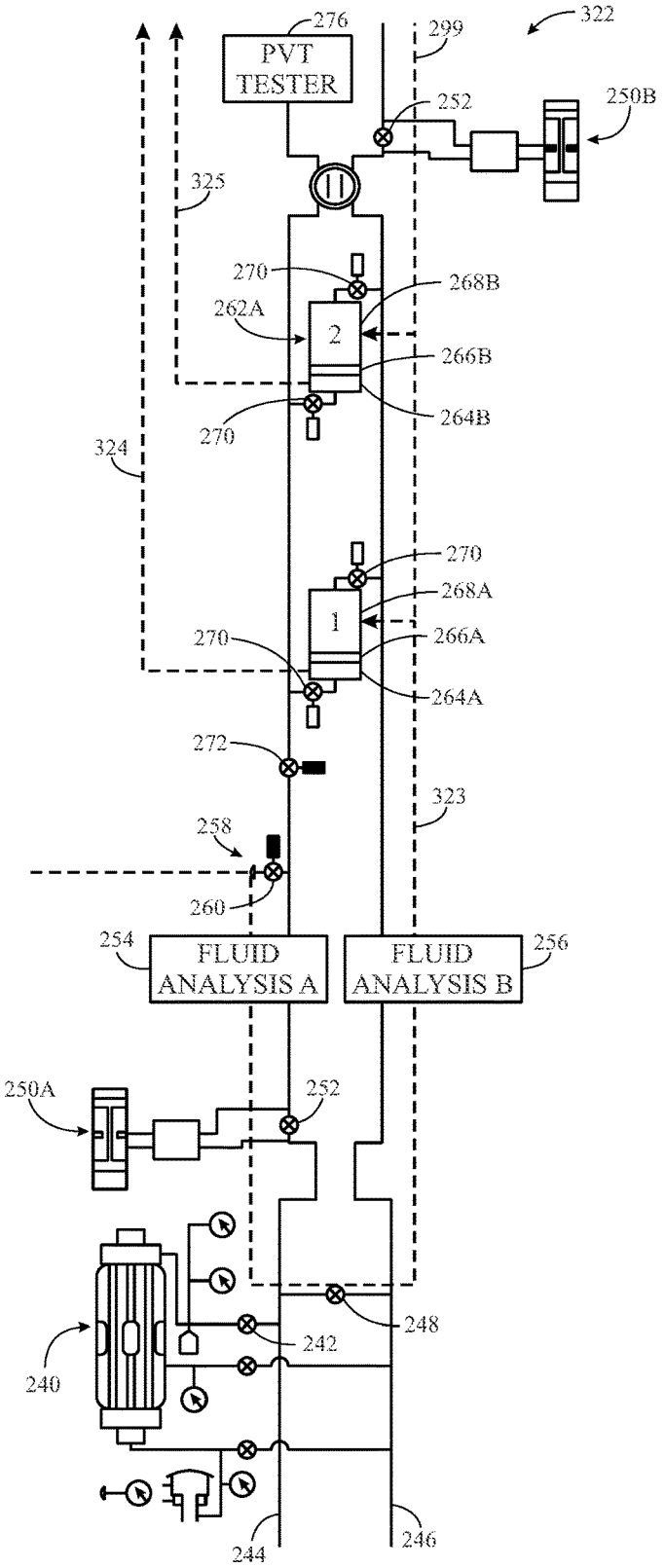

The first flowline valve 272 (and the second flowline valve 274, if present) may both be open while the samples are collected into the sample chambers 262A and 262B. To allow the formation fluids 50 to be mixed in-situ, the first flowline valve 272 may be closed (block 318) and the interval valve 242 may be closed and the comingle valve 248 may be opened (block 320). This may allow the lower pump 250A to pump external fluid from outside the wellbore 14 through the exit port 258 through the comingle valve 248 and into the second flowline 246. The external fluid operates as a force fluid that is pressed into the back volume 268A of the first sample chamber 262A and the back volume 268B of the second sample chamber 262B, thereby forcing fluid out of the first sample chamber 262A and the second sample chamber 262B (block 322). A fluid flow example for block 322 is shown in FIG. 22. In particular, fluid flow 323 illustrates the flow of the force fluid pushed by the lower pump 250A into the back volume 268A of the first sample chamber 262A and the back volume 268B of the second sample chamber 262B, which thereby causes fluid flow 324 as the stored formation fluid 50 from the first station is pushed out of the front volume 264A of the first sample chamber 262A and fluid flow 325 as the stored formation fluid 50 from the second station is pushed out of the front volume 264B of the second sample chamber 262B. The formation fluids 50 from the different stations thus mix in the first flowline 244 (block 326 of FIG. 19) as the mixture enters the PVT tester 276 (block 328 of FIG. 19).

As noted above, the lower pump 250A may be used to push a force fluid into the back volumes 268A and 268B of the first and second sample chambers 262A and 262B, causing the front volumes 264A and 264B of the first and second sample chambers 262A and 262B to output the formation fluids 50 from the different stations that are stored within them. It should be appreciated that, if the amount of fluid resistance into the first sample chambers 262A and the second sample chambers 262B are approximately equal, the flow rate of the fluid flows 324 and 325 shown in FIG. 22 may be approximately equal. This may produce approximately a half/half proportional mixture between the formation fluids 50 from the first station and second station, which are stored in the first sample chamber 262A and the second sample chamber 262B, respectively. This may result, for example, when the valves 270 to the first and second sample chambers 262A and 262B are both fully open. By varying the fluid resistance into the back volumes 268A or 268B or out of the front volumes 264A or 264B (e.g., by adjusting the valves 270 to a state between fully open and fully closed), the proportion of the formation fluids 50 output in the fluid flows 324 and 325 may be adjusted accordingly.

Figure 23:
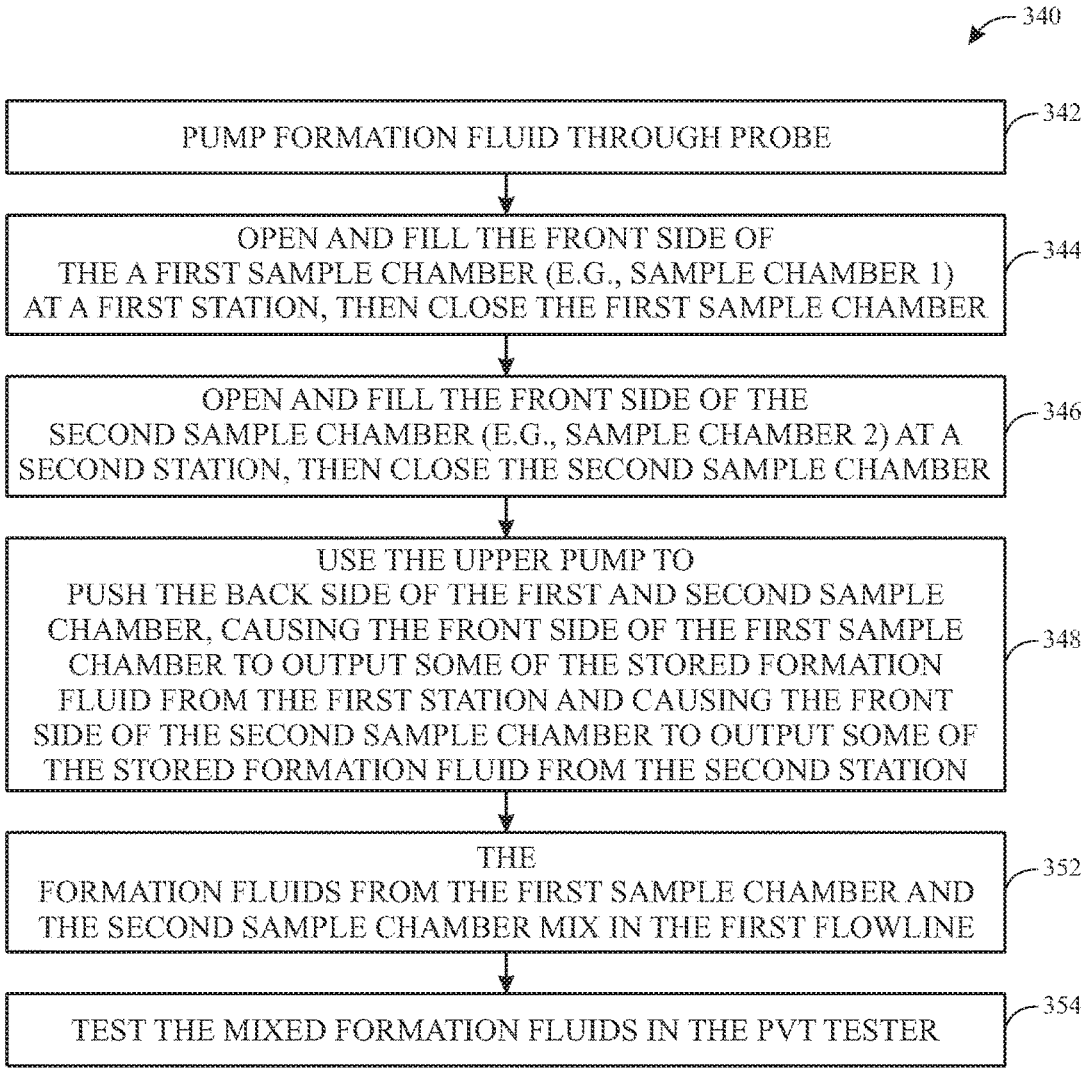
FIG. 23 is another flowchart of a method for using the downhole acquisition tool of FIG. 18.

While the flowchart of FIG. 19 describes mixing the formation fluids 50 using the lower pump 250A with the sampling system 42 shown in FIG. 18, FIG. 23 provides a flowchart for mixing the formation fluids 50 using the upper pump 250B. In like manner to the discussion above, formation fluid 50 may be pumped through the probe 240 at certain stations (block 342). At a first station, such as a depth within the first fluid zone 51A, a first sample chamber 262 (e.g., sample chamber 262A) may be opened by opening the valves 270 attached to the first sample chamber 262A. The formation fluid 50 may be pumped into a front volume 264A of the first sample chamber 262A (block 344 of FIG. 23), occurring in the same manner as shown by fluid flow 315 of FIG. 20. The first sample chamber 262A may be closed once the formation fluid 50 has been stored by closing the valves 270 attached to the first sample chamber 262A.

At a second station, such as at a depth within the second fluid zone 51B, a second sample chamber 262 (e.g., sample chamber 262B) may be opened by opening the valves 270 attached to the second sample chamber 262B. The formation fluid 50 may be pumped into a front volume 264B of the first sample chamber 262B (block 346 of FIG. 23), occurring in the same manner as shown by fluid flow 317 of FIG. 21. The second sample chamber 262B may be closed once the formation fluid 50 has been stored by closing the valves 270 attached to the second sample chamber 262B. Although blocks 344 and 346 describe filling the sample chamber 262A before the sample chamber 262B, it may be appreciated that these sample chambers 262 may be filled in reverse order.

Figure 24:
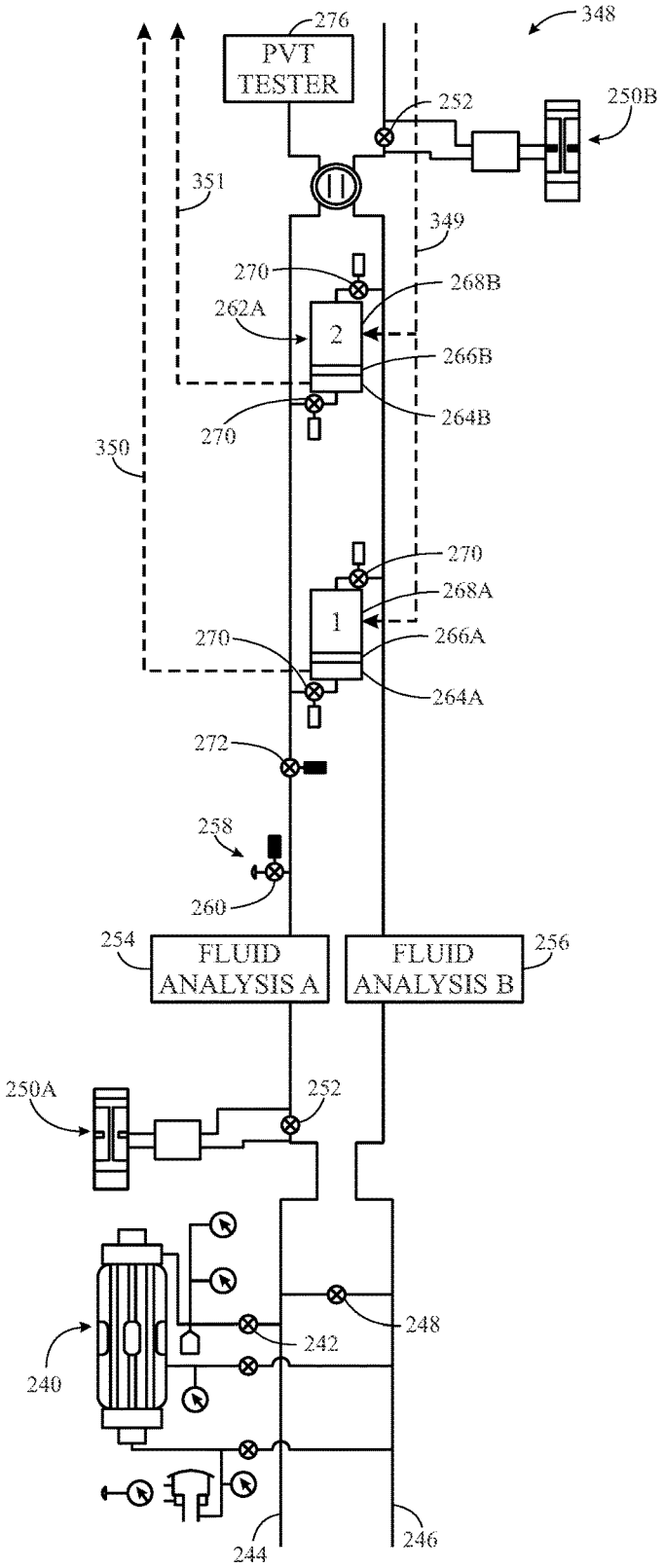
FIG. 24 is a schematic diagram representing fluid flow through the downhole acquisition tool during the method of FIG. 23.

While maintaining the comingle valve 248 in a closed position, the upper pump 250B may be activated to cause the formation fluids 50 to be mixed in-situ. In particular, the upper pump 250B may pump a force fluid over the second flowline 246. The force fluid is pressed into the back volume 268A of the first sample chamber 262A and the back volume 268B of the second sample chamber 262B, thereby forcing fluid out of the first sample chamber 262A and the second sample chamber 262B (block 348). A fluid flow example for block 348 is shown in FIG. 24. In particular, fluid flow 349 illustrates the flow of the force fluid pushed by the upper pump 250B into the back volume 268A of the first sample chamber 262A and the back volume 268B of the second sample chamber 262B, which thereby causes fluid flow 350 as the stored formation fluid 50 from the first station is pushed out of the front volume 264A of the first sample chamber 262A and fluid flow 351 as the stored formation fluid 50 from the second station is pushed out of the front volume 264B of the second sample chamber 262B. The formation fluids 50 from the different stations thus mix in the first flowline 244 (block 352 of FIG. 23) as the mixture enters the PVT tester 276 (block 354 of FIG. 23).

In using the upper pump 250B to push a force fluid into the back volumes 268A and 268B of the first and second sample chambers 262A and 262B, the front volumes 264A and 264B of the first and second sample chambers 262A and 262B output the formation fluids 50 from the different stations that are stored within them. It should be appreciated that, as noted above, if the amount of fluid resistance into the first sample chambers 262A and the second sample chambers 262B are approximately equal, the flow rate of the fluid flows 350 and 351 shown in FIG. 24 may be approximately equal. This may produce approximately a half/half proportional mixture between the formation fluids 50 from the first station and second station, which are stored in the first sample chamber 262A and the second sample chamber 262B, respectively. This may result, for example, when the valves 270 to the first and second sample chambers 262A and 262B are both fully open. By varying the fluid resistance into the back volumes 268A or 268B or out of the front volumes 264A or 264B (e.g., by adjusting the valves 270 to a state between fully open and fully closed), the proportion of the formation fluids 50 output in the fluid flows 350 and 351 may be adjusted accordingly.

The specific embodiments described above have been shown by way of example, and it should be understood that these embodiments may be susceptible to various modifications and alternative forms. It should be further understood that the claims are not intended to be limited to the particular forms disclosed, but rather to cover modifications, equivalents, and alternatives falling within the spirit and scope of this disclosure.

The invention claimed is:

1. A method comprising:

moving a downhole acquisition tool to a first station in a wellbore in a geological formation;

collecting a sample of first formation fluid from the first station using the downhole acquisition tool;

moving the downhole acquisition tool to a second station in the wellbore;

collecting a sample of second formation fluid from the second station using the downhole acquisition tool;

mixing a proportion of the first formation fluid and the second formation fluid within the downhole acquisition tool in-situ while the downhole acquisition tool is within the wellbore to obtain a formation fluid mixture; and passing the formation fluid mixture into a fluid testing component of the downhole acquisition tool while the downhole acquisition tool is in the wellbore to measure fluid properties of the formation fluid mixture in-situ.

2. The method of claim 1, wherein:

the first station is at a first depth in the wellbore where the first formation fluid derives substantially from a first fluid zone;

the second station is at a second depth in the wellbore where the formation fluid derives substantially from a second fluid zone; and the first fluid zone and the second fluid zone are substantially hydraulically isolated from one another in the geological formation.

3. The method of claim 1, wherein:

the sample of the first formation fluid is collected into a first sample chamber;

the sample of the second formation fluid is collected into a second sample chamber; and the first formation fluid and the second formation fluid are mixed in-situ including by:

transferring a first portion of the first formation fluid from the first sample chamber into a third sample chamber; and transferring a second portion of the second formation fluid from the second sample chamber into the third sample chamber to obtain the formation fluid mixture.

4. The method of claim 3, wherein a volume of the first portion and a volume of the second portion are substantially equal, thereby producing approximately a 1:1 mixture of the first formation fluid and the second formation fluid in the formation fluid mixture.

5. The method of claim 3, wherein a volume of the first portion and a volume of the second portion are substantially unequal, thereby producing a mixture of the first formation fluid and the second formation fluid in the formation fluid mixture that is not 1:1 in proportion.

6. The method of claim 3, wherein the first formation fluid and the second formation fluid are mixed in-situ including by transferring the formation fluid mixture from the third sample chamber into a fourth sample chamber to further mix the formation fluid mixture.

7. The method of claim 6, wherein the first formation fluid and the second formation fluid are mixed in-situ including by transferring the formation fluid mixture from the fourth sample chamber back into the third sample chamber to even further mix the formation fluid mixture.

8. The method of claim 1, wherein:

the sample of the first formation fluid is collected into a first sample chamber;

the sample of the second formation fluid is collected into a second sample chamber; and the first formation fluid and the second formation fluid are mixed in-situ including by forcing the first formation fluid out of the first sample chamber while simultaneously forcing the second formation fluid out of the second sample chamber, thereby causing the first formation fluid and the second formation fluid to mix in a flowline of the downhole acquisition tool to obtain the formation fluid mixture.

9. The method of claim 8, wherein the first formation fluid is forced out of the first sample chamber at a first flowrate and the second formation fluid is forced out of the second sample chamber at a second flowrate, wherein the flowrates are approximately equal.

10. The method of claim 8, wherein the first formation fluid is forced out of the first sample chamber using a force fluid from a first pump and wherein the second formation fluid is forced out of the second sample chamber using the force fluid from the same first pump.

11. The method of claim 8, wherein the first formation fluid is forced out of the first sample chamber using a force fluid from a first pump and wherein the second formation fluid is forced out of the second sample chamber using a force fluid from a second pump not in fluid communication with the first pump.

12. The method of claim 11, wherein:

the first formation fluid is forced out of the first sample chamber at a first flowrate that is substantially equal to a force fluid flowrate from the first pump; and the second formation fluid is forced out of the second sample chamber at a second flowrate that is substantially equal to a force fluid flowrate from the second pump;

wherein the first flowrate and the second flowrate are unequal, thereby causing a proportion of the formation fluid mixture to be controllable by a proportion of the first flowrate and the second flowrate.

13. The method of claim 1, wherein:

the sample of the first formation fluid is initially collected into a first sample chamber; and the sample of the second formation fluid is initially collected into the same first sample chamber, thereby causing the first formation fluid and the second formation fluid to mix inside the first sample chamber to obtain the formation fluid mixture.

14. A downhole acquisition tool configured to be placed in a wellbore in a geological formation and perform in-situ fluid testing of a formation fluid mixture that includes first formation fluid from a first station in the wellbore and second formation fluid from a second station in the wellbore, the downhole acquisition tool comprising:

a first flowline;

a second flowline;

a comingle valve configured to selectively permit or deny fluid communication between the first flowline and the second flowline;

a probe configured to draw formation fluid in from outside the downhole acquisition tool onto the first flowline via an interval valve disposed between the first flowline and the probe;

a first sample chamber having a first front volume attached to a first location on the first flowline and a first back volume attached to a first location on the second flowline, wherein the first front volume and the first back volume are separated from one another by a first separating piston such that as an amount of fluid that is held by the first front volume changes, an amount of fluid that is held by the first back volume changes in an equal but opposite way;

a second sample chamber having a second front volume attached to a second location on the first flowline and a second back volume attached to a second location on the second flowline, wherein the second location on the first flowline is beneath the first location on the first flowline and the second location on the second flowline is beneath the first location on the second flowline, and wherein the second front volume and the second back volume are separated from one another by a second separating piston such that as an amount of fluid that is held by the second front volume changes, an amount of fluid that is held by the second back volume changes in an equal but opposite way;

a first pump configured to pump fluid up or down the first flowline, wherein the first pump is attached to the first flowline at a third location on the first flowline, wherein the third location is beneath the first location on the first flowline and the second location on the first flowline; and a pressure-volume-temperature tester disposed along the first flowline;

wherein:

the first pump is configured, when the downhole acquisition tool is at the first station, to pump the first formation fluid from the first station into one of the first front volume of the first sample chamber or the second front volume of the second sample chamber;

the first pump is configured, when the downhole acquisition tool is at the second station, to pump the second formation fluid from the second station into the other one of the first front volume of the first sample chamber or the second front volume of the second sample chamber; and the first back volume of the first sample chamber and the second back volume of the second sample chamber are configured to be simultaneously pressed with force fluid to cause a simultaneous release of the first formation fluid out of the first front volume of the first sample chamber and the second formation fluid out of the second front volume of the second sample chamber onto the first flowline and into the pressure-volume-temperature tester as the formation fluid mixture.

15. The downhole acquisition tool of claim 14, comprising:

a first flowline valve attached at a fourth location on the first flowline, wherein the fourth location is located between the second location and the third location; and an exit port attached to a fifth location on the first flowline, wherein the fifth location is located between the fourth location and the third location;

wherein, after the first formation fluid and the second formation fluid have been collected, the exit port is configured to be opened, the first flowline valve is configured to be closed, the comingle valve is configured to be opened, and the first pump is configured to press force fluid deriving from the exit port to at least the second back volume of the second sample chamber, thereby causing a release of the second formation fluid onto the first flowline, wherein the first back volume of the first sample chamber is configured to be pressed with force fluid at the same time, resulting in the simultaneous release of the first formation fluid out of the first front volume of the first sample chamber and the second formation fluid out of the second front volume of the second sample chamber onto the first flowline and into the pressure-volume-temperature tester as the formation fluid mixture.

16. The downhole acquisition tool of claim 15, wherein the first pump is configured to press the force fluid deriving from the exit port to the first back volume of the first sample chamber, thereby causing a release of the first formation fluid onto the first flowline at the same time as the second formation fluid.

17. The downhole acquisition tool of claim 14, comprising a second pump attached to a third location on the second flowline, wherein the third location on the second flowline is above the first location on the second flowline and above the second location on the second flowline, wherein the second pump is configured to press force fluid to at least the first back volume of the first sample chamber, thereby causing a release of the first formation fluid onto the first flowline, wherein the second back volume of the second sample chamber is configured to be pressed with force fluid at the same time, resulting in the simultaneous release of the first formation fluid out of the first front volume of the first sample chamber and the second formation fluid out of the second front volume of the second sample chamber onto the first flowline and into the pressure-volume-temperature tester as the formation fluid mixture.

18. The downhole acquisition tool of claim 17, comprising:

a first flowline valve attached at a fourth location on the first flowline, wherein the fourth location is located between the second location and the third location; and an exit port attached to a fifth location on the first flowline, wherein the fifth location is between the fourth location on the first flowline and the third location on the first flowline; and a second flowline valve attached to a fourth location on the second flowline, wherein the fourth location on the second flowline is between the first location on the second flowline and the second location on the second flowline;

wherein, after the first formation fluid and the second formation fluid have been collected, the following is configured to occur over a common period of time:

the exit port is configured to be opened;

the first flowline valve is configured to be closed;

the comingle valve is configured to be opened;

the second flowline valve is configured to be closed;

the first pump is configured to press force fluid deriving from the exit port to the second back volume of the second sample chamber at a first flow rate, thereby causing the release of the second formation fluid onto the first flowline at the first flow rate; and the second pump is configured to press force fluid to the first back volume of the first sample chamber at a second flow rate, thereby causing the release of the first formation fluid onto the first flowline at the second flow rate, resulting in the simultaneous release of the first formation fluid out of the first front volume of the first sample chamber and the second formation fluid out of the second front volume of the second sample chamber onto the first flowline and into the pressure-volume-temperature tester as the formation fluid mixture.

19. The downhole acquisition tool of claim 18, wherein the first pump pumps force fluid at the first flow rate and the second pump pumps force fluid at the second flow rate, wherein the first flow rate is different from the second flow rate.

20. A method comprising:

moving a downhole acquisition tool to a first station in a wellbore in a geological formation;

applying a probe to a wall of the wellbore at the first station, wherein the probe is attached to a first flowline;

using a pump set to pump in a first direction along the first flowline, pumping first formation fluid from the probe onto a first flowline into a first sample chamber attached to the first flowline via a pump attached to a location on the first flowline between the probe and the first sample chamber;

moving the downhole acquisition tool to a second station in the wellbore;

applying the probe to the wall of the wellbore at the second station;

pumping second formation fluid from the probe onto the first flowline into a second sample chamber attached to the first flowline via the pump;

reversing the pump to pump in a second direction opposite the first direction along the first flowline;

using the pump to pump a first portion of the first formation fluid out of the first sample chamber along the first flowline into a third sample chamber attached to a location on the first flowline opposite the pump from the first and second sample chambers;

using the pump to pump a second portion of the second formation fluid out of the second sample chamber along the first flowline into the third sample chamber attached to the location on the first flowline opposite the pump from the first and second sample chambers, thereby creating a formation fluid mixture;

reversing the pump to pump in the first direction along the first flowline; and using the pump to pump the formation fluid mixture into a fluid testing component attached to a location on the first flowline on the same side of the pump as the first and second sample chambers while the downhole acquisition tool is in the wellbore to measure fluid properties of the formation fluid mixture in-situ.

* * * * *